US010293506B2

(12) United States Patent
Strunk

(10) Patent No.: US 10,293,506 B2
(45) Date of Patent: May 21, 2019

(54) JACKET-STRIPPING TOOL KITS, METHODS OF REMOVING ONE OR MORE EXTERNAL JACKET LAYERS, AND BLADES

(71) Applicant: Titeflex Corporation, Springfield, MA (US)

(72) Inventor: Jordan Strunk, Portland, TN (US)

(73) Assignee: Titeflex Corporation, Springfield, MA (US)

( * ) Notice: Subject to any disclaimer, the term of this patent is extended or adjusted under 35 U.S.C. 154(b) by 885 days.

(21) Appl. No.: 14/336,313

(22) Filed: Jul. 21, 2014

(65) Prior Publication Data

US 2014/0373694 A1 Dec. 25, 2014

Related U.S. Application Data

(63) Continuation of application No. PCT/US2014/043455, filed on Jun. 20, 2014.
(Continued)

(51) Int. Cl.
*B26D 3/16* (2006.01)
*B21D 45/06* (2006.01)
(Continued)

(52) U.S. Cl.
CPC ..... *B26D 3/166* (2013.01); *B21D 45/06* (2013.01); *B26D 3/169* (2013.01); *B26D 3/282* (2013.01);
(Continued)

(58) Field of Classification Search
CPC ..... B26D 3/16; B26D 3/166; B26D 3/162; B26D 3/169; B26D 3/282; B26D 3/001;
(Continued)

(56) References Cited

U.S. PATENT DOCUMENTS 3,254,407 A 6/1966 Apa et al.
3,304,605 A 2/1967 Stark
(Continued)

FOREIGN PATENT DOCUMENTS

CN 201198036 Y 2/2009
DE 3412218 C3 7/2001

OTHER PUBLICATIONS

International Search Report and Written Opinion for Application No. PCT/US2014/043455 (dated 2014).
(Continued)

*Primary Examiner* — Phong H Nguyen
(74) *Attorney, Agent, or Firm* — Saul Ewing Arnstein & Lehr LLP; Brian R. Landry

(57) ABSTRACT

One aspect of the invention provides a jacket-stripping tool including: a reference stop adapted and configured to contact an end of corrugated stainless steel tubing; and one or more cutting blades arranged substantially perpendicular to a central axis of the tool and adapted and configured to create one or more cuts through one or more external jacket layers of the corrugated stainless steel tubing. At least one of the one or more cutting blades is positioned relative to the reference stop such that the at least one of the one or more cutting blades is a multiple of a distance between adjacent corrugation valleys of the corrugated stainless steel tubing.

15 Claims, 17 Drawing Sheets

Related U.S. Application Data

(60) Provisional application No. 61/837,352, filed on Jun. 20, 2013.

(51) Int. Cl.
*B26D 3/28* (2006.01)
*B26D 1/00* (2006.01)

(52) U.S. Cl.
CPC ... *B26D 2001/0053* (2013.01); *Y10T 83/0524* (2015.04)

(58) Field of Classification Search
CPC .. B26D 3/08; B26D 2001/0053; B21D 45/06; B23D 21/00; B23D 21/02; B23D 21/06; B23D 21/10; Y10T 83/0524; Y10T 83/04
USPC ..... 30/90.1, 90.2, 90.8, 91.1, 91.2, 90.4, 30/90.6, 90.7; 81/9.4, 9.41, 9.42
See application file for complete search history.

(56) References Cited

U.S. PATENT DOCUMENTS

| | | | | | |
|---|---|---|---|---|---|
| 3,895,426 | A | | 7/1975 | Papsdorf | |
| 4,026,017 | A | | 5/1977 | Arnold | |
| 4,059,892 | A | * | 11/1977 | Siden | H02G 1/1236 30/90.1 |
| 4,108,028 | A | * | 8/1978 | Perrino | H02G 1/1214 30/90.1 |
| 4,433,484 | A | | 2/1984 | Antisdel et al. | |
| 4,587,731 | A | | 5/1986 | Krampe | |
| 4,706,384 | A | | 11/1987 | Schreiber et al. | |
| 4,799,406 | A | | 1/1989 | Diaz-De-Guerenu-Aguirrebeitia | |
| 4,905,373 | A | * | 3/1990 | Krampe | H02G 1/1229 30/90.6 |
| 5,009,006 | A | * | 4/1991 | Sawyer | H02G 1/1229 30/90.6 |
| 5,074,043 | A | | 12/1991 | Mills | |
| 5,377,410 | A | | 1/1995 | Welch | |
| 5,749,270 | A | | 5/1998 | Bourbeau | |
| 5,819,615 | A | | 10/1998 | Dale et al. | |
| 6,467,171 | B2 | | 10/2002 | Tarpill | |
| 6,477,776 | B1 | * | 11/2002 | Jee | H02G 1/1224 30/90.1 |
| 6,679,381 | B1 | * | 1/2004 | Bush | B65D 43/164 206/531 |
| 6,964,098 | B1 | | 11/2005 | Belew et al. | |
| 7,243,429 | B2 | | 7/2007 | Landes et al. | |
| 7,814,662 | B2 | | 10/2010 | O'Neal | |
| 7,984,553 | B1 | | 7/2011 | Miller et al. | |
| 2001/0054231 | A1 | | 12/2001 | Miller et al. | |
| 2005/0072003 | A1 | | 4/2005 | Morrow | |
| 2009/0019704 | A1 | | 1/2009 | Ehret et al. | |
| 2009/0100681 | A1 | | 4/2009 | Tarpill | |
| 2010/0090459 | A1 | | 4/2010 | Duquette et al. | |
| 2011/0192033 | A1 | * | 8/2011 | Kasprzycki | H02G 1/1224 30/91.2 |
| 2011/0215570 | A1 | | 9/2011 | Treichel et al. | |

OTHER PUBLICATIONS

Moroso, "Enhanced Ignition Wire Stripping Tool, Wire Stripping Tool, and Adjustable Wire Stripping Tool", http://www.moroso.com/catalog/categorydisplay.asp?catcode=27347, (May 19, 2013).
Gastite, FlashShield CSST Fittings and Installation Guide (2013).
Pro-Flex CSST, Fitting Assembly (2013).
Gastite, Design and Installation Guide, www.gastite.com/digital/dandiguidefindex.html (Jan. 2013).
Klauke, Full Line Catalogue 2012/2013, pp. 479-495 (2012).
Communication of Extended European Search Report, European Patent Application No. 14813052.9, dated Jan. 5, 2017.
Moroso Performance Products, Inc., Moroso Enhanced Ignition Wire Stripping Tool (http://www.moroso.com/catalog/categorydisplay.asp?catcode=27347), (May 19, 2013).
First Office Action, Chinese Patent Application No. 2014800341502, dated Aug. 2, 2016.
Internet Archive, "Cable Strippers—JOKARI" (downloaded Dec. 8, 2017).
JOKARI-Krampe GmbH, Press Release, "Joining the JOKARI family—Introducing the Secura Coaxi No. 1 stripper" (Apr. 15, 2012).

* cited by examiner

SCALE 3 : 1

SCALE 6 : 1

900

(SCALE 30:1)

JACKET-STRIPPING TOOL KITS, METHODS OF REMOVING ONE OR MORE EXTERNAL JACKET LAYERS, AND BLADES

CROSS-REFERENCE TO RELATED APPLICATION

This application is a continuation under 35 U.S.C. § 120 of International Application No. PCT/US14/43455, filed Jun. 20, 2014, which claims priority to U.S. Provisional Patent Application Ser. No. 61/837,352, filed Jun. 20, 2013. The entire content of these applications is hereby incorporated by reference herein.

BACKGROUND OF THE INVENTION

Gas and liquid piping systems utilizing corrugated stainless steel tubing ("CSST") and fittings can be designed for use in combination with elevated pressures of up to about 25 psi or more and provide advantages over traditional rigid black iron piping systems in terms of ease and speed of installation, elimination of onsite measuring, and reduction in the need for certain fittings such as elbows, tees, and couplings. Undesirably, the thin metal walls are vulnerable to failure when exposed to physical or electrical forces, such as lightning or fault currents.

Often, electrical currents will occur inside a structure. These electrical currents can be the result of power fault currents or induced currents resulting from lightning interactions with a house or structure. The term "fault current" is typically used to describe an overload in an electrical system, but is used broadly herein to include any electrical current that is not normal in a specific system. Electrical currents from lightning can reach a structure directly or indirectly. While both direct and indirect currents may enter a structure through a particular system, voltage can be induced in other systems in the structure, especially those in close proximity to piping systems. This can often result in an electrical flashover or are between the adjacent systems. A flashover occurs when a large voltage differential exists between two electrical conductors, causing the air to ionize, the material between the conductive bodies to be punctured by the high voltage, and formation of a spark.

It usually takes a very large voltage differential to create a flashover through a good dielectric material. When a flashover does occur, the flow of electrons through the ionized path causes energy dissipation through heating and a shockwave (i.e., sound). The extent of heat and shock is directly related to the duration and magnitude of the electrical energy in the flashover. Frequently, the voltage required to breakdown a dielectric material is enough to drive a relatively large amount of energy across the associated spark often resulting in damage to both conductors and any material between them. The primary mode of failure is extreme heating and melting of these materials.

Metals are electrically conductive materials, making CSST a very good pathway for electrical currents. This leads to the potential for a flashover if the CSST is installed in close proximity to another conductor within a structure and either one becomes energized. A flashover like this is often the result of a lightning event but it is foreseeable that other events may also be capable a producing a sufficient voltage differential between conductors. It is possible that a flash like this can cause enough heat generation to melt a hole in the CSST, allowing fuel gas to escape. This scenario is worsened by the dielectric jacket that often surrounds CSST. This jacket typically breaks down in a very small area, creating a pinhole as a result of the flashover. This phenomenon focuses the flash and concentrates the heating of the stainless steel inside. The result is a reduced capability of the CSST to resist puncture from flashover compared to unjacketed pipe.

SUMMARY OF THE INVENTION

One aspect of the invention provides a jacket-stripping tool including: a reference stop adapted and configured to contact an end of corrugated stainless steel tubing; and one or more cutting blades arranged substantially perpendicular to a central axis of the tool and adapted and configured to create one or more cuts through one or more external jacket layers of the corrugated stainless steel tubing. At least one of the one or more cutting blades is positioned relative to the reference stop such that the at least one of the one or more cutting blades is a multiple of a distance between adjacent corrugation valleys of the corrugated stainless steel tubing.

This aspect of the invention can include a variety of embodiments. At least one of the one or more blades can be positioned so that a cutting edge of the cutting blade is angled away from the reference stop. The reference stop can divide the tool into a first tool end and a second tool end, wherein at least one of the one or more cutting blades is positioned in each of the first tool end and the second tool end. The tool can include two substantially semicircular halves.

At least one of the one or more cutting blades can be included on each of the two substantially semicircular halves. The substantially semicircular halves can be coupled by a hinge. The hinge can be a living hinge. The at least one of the one or more cutting blades can include a substantially flat surface between two facets.

Another aspect of the invention includes a jacket-stripping tool including: a body defining a substantially cylindrical internal chamber; a reference stop dividing the chamber to form a first tool end and a second tool end, the reference stop adapted and configured to contact an end of corrugated stainless steel tubing; a first set of one or more cutting blades; and a second set of one or more cutting blades arranged substantially perpendicular to a central axis of the tool in the second tool end. At least one of the first set of one or more cutting blades can be: arranged substantially perpendicular to a central axis of the tool in the first tool end; positioned relative to the reference stop such the at least one of the first set of one or more cutting blades is a multiple of a distance between adjacent corrugation valleys of the corrugated stainless steel tubing; and protruding from the body into the chamber such that when a length of corrugated stainless steel tubing cut at an end coinciding with a corrugation valley is inserted in the first tool end and the body is compressed around a length of corrugated stainless steel tubing and rotated, the at least one of the first set of one or more cutting blades cuts through all jacket layers of the length of tubing at another corrugation valley. The second set of cutting blades can include a substantially flat surface between two facets.

This aspect of the invention can have a variety of embodiments. The second set of cutting blades can protrude from the body into the chamber such that when the length of corrugated stainless steel tubing is inserted into the second tool end and the body is compressed around the length of corrugated stainless steel tubing and rotated, the at least one of the second set of one or more cutting blades cuts through an outer jacket layer, but does not cut through an intermediate conductive layer. The tool can include two substantially semicircular halves. The substantially semicircular halves can be coupled by a hinge.

Another aspect of the invention provides a kit including: the tool as described herein and instructions to: cut a length of corrugated stainless steel tubing at a corrugation valley; place the tool over an end of the length of corrugated stainless steel tubing so that the end of the length of corrugated stainless steel tubing contacts the reference stop of the tool; compress and rotate the tool to cut through one or more jacket layers of the length of the corrugated stainless steel tubing; and pull the tool axially toward the end of the length of the corrugated stainless steel tubing to remove the one or more jacket layers.

This aspect of invention can have a variety of embodiments. The instructions can further include a step of partially expanding the tool prior to the pulling step.

Another aspect of the invention can include a method of removing one or more external jacket layers from corrugated stainless steel tubing. The method can include: placing a length of corrugated stainless steel tubing in the tool as described herein such that the one or more cutting blades contact an outermost jacket layer of the length of corrugated stainless steel tubing; rotating the tool with respect to the length of corrugated stainless steel tubing; placing the length of corrugated stainless steel tubing in the tool such that the one or more internal annular ribs penetrate the one or more cuts; and pulling the tool axially to remove the one or more external jacket layers.

Another aspect of the invention provides a jacket-stripping tool including: one or more cutting blades arranged substantially perpendicular to a central axis of the tool and adapted and configured to create one or more cuts through one or more external jacket layers of tubing or wire; and one or more internal annular ribs adapted and configured to be received in the one or more cuts and to remove the one or more jacket layers cut by the one or more cutting blades when the tool is pulled axially with respect to the tubing or wire.

This aspect of the invention can have a variety of embodiments. The one or more cutting blades and the one or more internal annular ribs can be positioned on substantially opposite ends of the tool. The one or more cutting blades are razor blades. The one or more cutting blades can be removably mounted in one or more slits.

The one or more cutting blades can be removably held in place by a cover. The cover can be removably held in place by one or more tabs. The one or more tabs can extend from the tool and can be adapted and configured to flex during insertion into one or more slots on the cover.

The tool can include two substantially semicircular halves. A cutting blade can be included on each of the two substantially semicircular halves. An internal annular rib can be included on each of the two substantially semicircular halves. The substantially semicircular halves can be coupled by a hinge. The hinge can be a living hinge. The substantially semicircular halves can constitute arcs of less than 180° so that the substantially semicircular halves can be compressed to accommodate undersized tubing or wiring. The substantially semicircular halves can constitute arcs greater than or equal about 177.5°, but less than 180°. The substantially semicircular halves can constitute arcs greater than or equal about 179.5°, but less than 180°.

The tool can include a divider between the one or more cutting blades and the one or more internal annular ribs. The one or more cutting blades and the one or more internal annular ribs can be spaced an equal distance from the divider.

The one or more cutting blades can comprise four cutting blades. The tool can include at least two cutting blades and the at least two cutting blades can be mounted at least two mounting distances with respect to the central axis of the tool.

An internal diameter of the tool adjacent to a first of the at least two cutting blades can be different than an internal diameter of the tool adjacent to a second of the at least two cutting blades.

The tool can be sized to remove one or more external jacket layers from tubing having a diameter selected from the group consisting of: ⅜", ½", ¾", 1", 1¼", 1½", and 2". The tubing can be corrugated stainless steel tubing.

The tool can include at least two internal ribs and an internal diameter of a first of the at least two internal annular ribs can be different than an internal diameter of a second of the at least two internal ribs.

A distance between at least one of the one or more cutting blades and an internal diameter of the tool adjacent to the at least one of the one or more cutting blades can be substantially equal to a thickness of the one or more external jacket layers of tubing or wire.

Another aspect of the invention provides a kit including the tool as described herein and instructions to: place a length of tubing or wire in the tool such that the one or more cutting blades contact an outermost jacket layer of the length of tubing or wire; rotate the tool with respect to the length of tubing or wire; place the length of tubing or wire in the tool such that the one or more internal annular ribs penetrate the one or more cuts; and pull the tool axially to remove the one or more external jacket layers.

Another aspect of the invention provides a method of removing one or more external jacket layers from tubing or wire. The method includes: placing a length of tubing or wire in the tool as described herein such that the one or more cutting blades contact an outermost jacket layer of the length of tubing or wire; rotating the tool with respect to the length of tubing or wire; placing the length of tubing or wire in the tool such that the one or more internal annular ribs penetrate the one or more cuts; and pulling the tool axially to remove the one or more external jacket layers.

Another aspect of the invention provides a blade including two facets and a substantially flat surface between the two facets. This aspect of the invention can have a variety of embodiments. For example, the cross-sectional distance width of the substantially flat surface can be between about 0.001" and about 0.006".

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DEFINITIONS

Figure 1B:
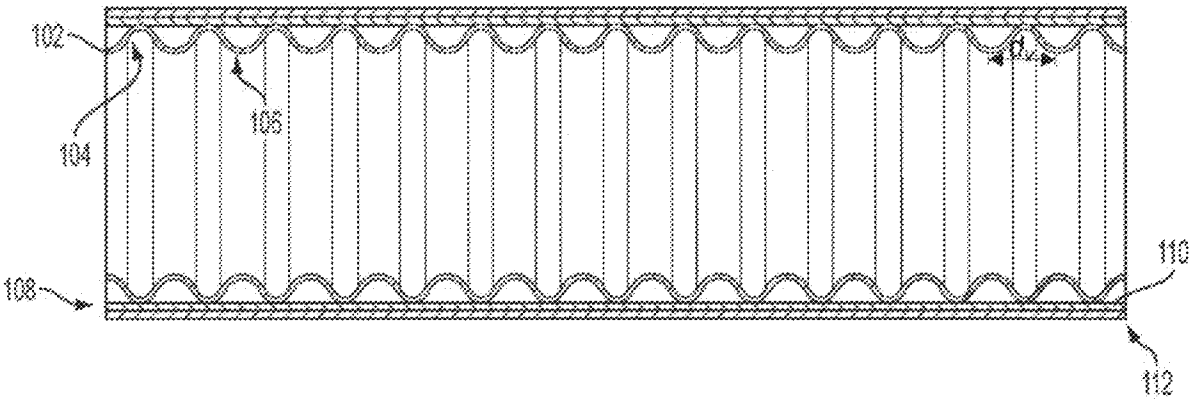
FIGS. 1A and 1B depict a multi-layer jacketed tube in accordance with the prior art.

The instant invention is most clearly understood with reference to the following definitions:

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used herein, the term "alloy" refers to a homogenous mixture or metallic solid solution composed of two or more elements. Examples of alloys include austenitic nickel-chromium-based superalloys, brass, bronze, steel, low carbon steel, phosphor bronze, stainless steel, and the like.

As used in the specification and claims, the terms "comprises," "comprising," "containing," "having," and the like can have the meaning ascribed to them in U.S. patent law and can mean "includes," "including," and the like.

As used herein, the terms "corrugated stainless steel tubing" and "CSST" refer to any type of semi-flexible tubing or piping that can accommodate corrosive or aggressive gases or liquids. In some embodiments, CSST is designed and/or approved for conveyance of fuel gases such as natural gas, methane, propane, and the like. For example, CSST can comply with a standard such as the ANSI LC 1-2005/CSA 6.26-2005 Standard for Fuel Gas Piping Systems Using Corrugated Stainless Steel Tubing. The inventions described herein can be utilized in conjunction with all commercially available CSST products including, but not limited to CSST sold under the GASTITE® and FLASHSHIELD® brands by Titeflex Corporation of Portland, Tenn.; TRACPIPE® and COUNTERSTRIKE® brands by OmegaFlex, Inc. of Exton, Pa.; WARDFLEX® brand by Ward Manufacturing of Blossburg, Pa.; PRO-FLEX® by Tru-Flex Metal Hose Corp. of Hillsboro, Ind.; and DIAMONDBACK™ brand by Metal Fab, Inc. of Wichita, Kans.

Unless specifically stated or obvious from context, the term "or," as used herein, is understood to be inclusive.

As used herein, the term "metal" refers to any chemical element that is a good conductor of electricity and/or heat. Examples of metals include, but are not limited to, aluminum, cadmium, niobium (also known as "columbium"), copper, gold, iron, nickel, platinum, silver, tantalum, titanium, zinc, zirconium, and the like.

As used herein, the term "resin" refers to any synthetic or naturally occurring polymer.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

Corrugated Tubing

Figure 1A:
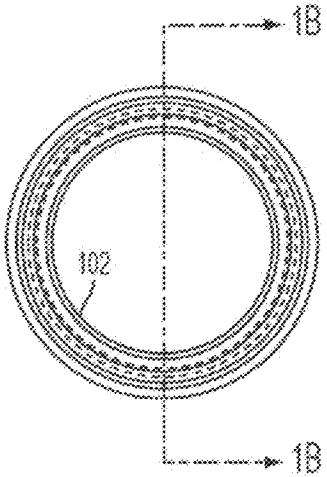
Figure 2B:
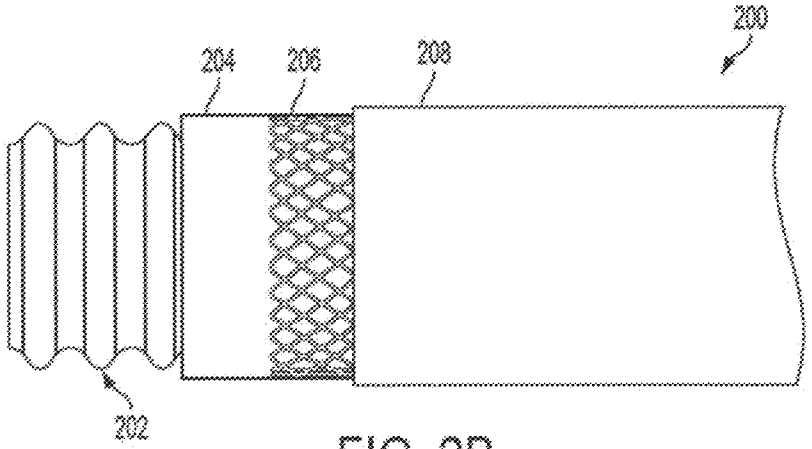
FIGS. 2A-2D depict an energy dissipative tube in accordance with the prior art.
Figure 2D:
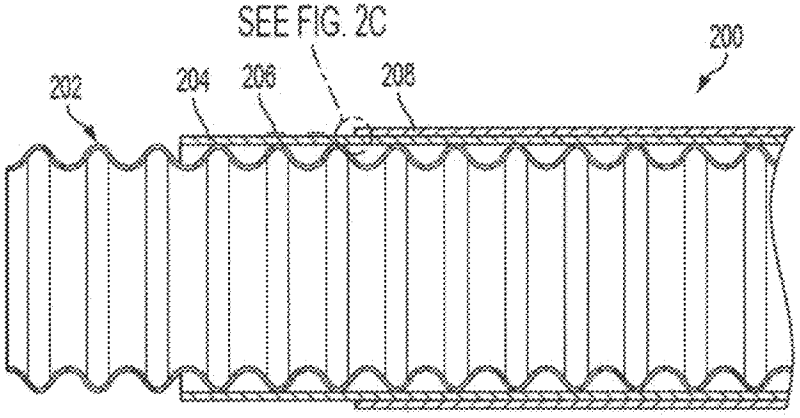
Figure 2A:
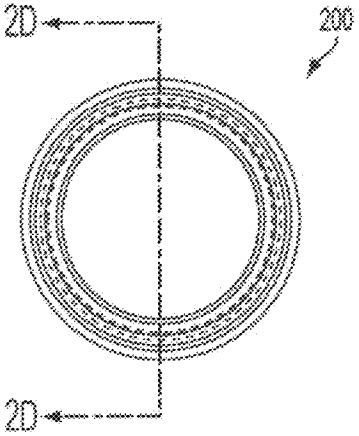
Figure 2C:
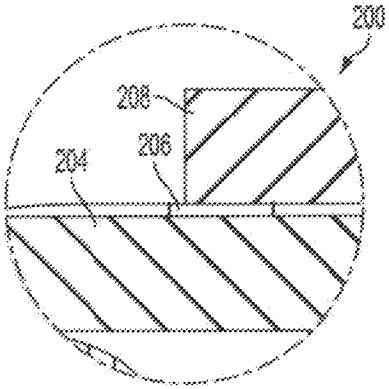

Referring to FIGS. 1A and 1B, a length of corrugated tubing 102 according to the prior art is provided. The corrugated tubing 102 can be composed of stainless steel or any other suitable material. The tubing 102 contains a number of corrugation peaks 104 and corrugation valleys 106, which have a substantially uniform geometry and spacing. For example, the distance $d_v$ between adjacent corrugation valleys 106 (as measured from the inflection point in each valley) will be substantially uniform within particular type of tubing 102. A jacket 108 (e.g., a multi-layer jacket) covers the outside of the tubing 102.

The jacket 108 can include a plurality of layers 110, 112. The layers 110, 112 generally form an annulus around the tubing 102, but may have a circular or non-circular cross-section.

Energy Dissipative Tubing

Referring now to FIGS. 2A-2D, in order to better absorb energy from fault currents and lightning strikes, energy dissipative jackets are provided that dissipate electrical and thermal energy throughout the respective jackets, thereby protecting the tubing 202. The term "dissipate" encompasses distributing electrical energy to an appropriate grounding device such as a fitting.

Energy dissipative tubing is described briefly below and is further described in U.S. Patent Application Publication Nos. 2011/0041944 and 2013/0192708.

Preferred embodiments of energy dissipative jackets preferably include one or more conductive layers for distributing electricity and heat. The conductive layers can include, for example, conductive resins and/or metals as discussed herein.

One embodiment of energy dissipative tubing 200 is depicted in FIGS. 2A-2D. The energy dissipative tubing 200 includes a length of tubing 202. The tubing 202 can be metal tubing, thin-walled metal tubing, corrugated tubing, corrugated stainless steel tubing, or the like.

Tubing 202 is surrounded by a first resin layer 204, a metal layer 206, and a second resin layer 208. Resin layers 204, 208 can be formed from insulative and/or conductive resins.

Insulating resin layers can be formed from a variety of materials. In some embodiments, an insulating elastic layer includes polytetrafluoroethylene (PTFE). Other suitable insulators include polyolefin compounds, thermoplastic polymers, thermoset polymers, polymer compounds, polyethylene, crosslinked polyethylene, UV-resistant polyethylene, ethylene-propylene rubber, silicone rubber, polyvinyl chloride (PVC), ethylene tetrafluoroethylene (ETFE), and ethylene propylene diene monomer (EPDM) rubber.

In some embodiments, each resin layer 204, 208 has a thickness of about 0.015" to about 0.035".

Metal layer 206 can include one or more metals (e.g., ductile metals) and alloys thereof. The metal(s) can be formed into foils, perforated foils, tapes, perforated tapes, cables, wires, strands, meshes, braids, and the like.

In some embodiments, the metal layer 206 is an expanded metal foil as further described in U.S. Patent Application Publication No. 2011/0041944. An exemplary embodiment of energy dissipative tubing 200 with expanded metal foil is depicted in FIG. 2.

In some embodiments, the metal layer 206 completely surrounds the first resin layer 204. In such embodiments, the metal may overlap and/or be welded or soldered in some regions. In still other embodiments, the metal layer 206 can be wrapped spirally or helically around the first resin layer 204. In such an embodiment, the metal layer 206 can overlap or substantially surround the first resin layer 204

In some embodiments, the metal layer 206 is a conventional, non-expanded metal foil, such as aluminum or copper foil that can, in some embodiments, completely envelop the inner resin layer 206.

Various thicknesses of the resin layers 204, 208 and the metal layer 206 can be selected to achieve desired resistance to lightning strikes and physical damage while maintaining desired levels of flexibility.

Sealing Devices

Figure 3A:
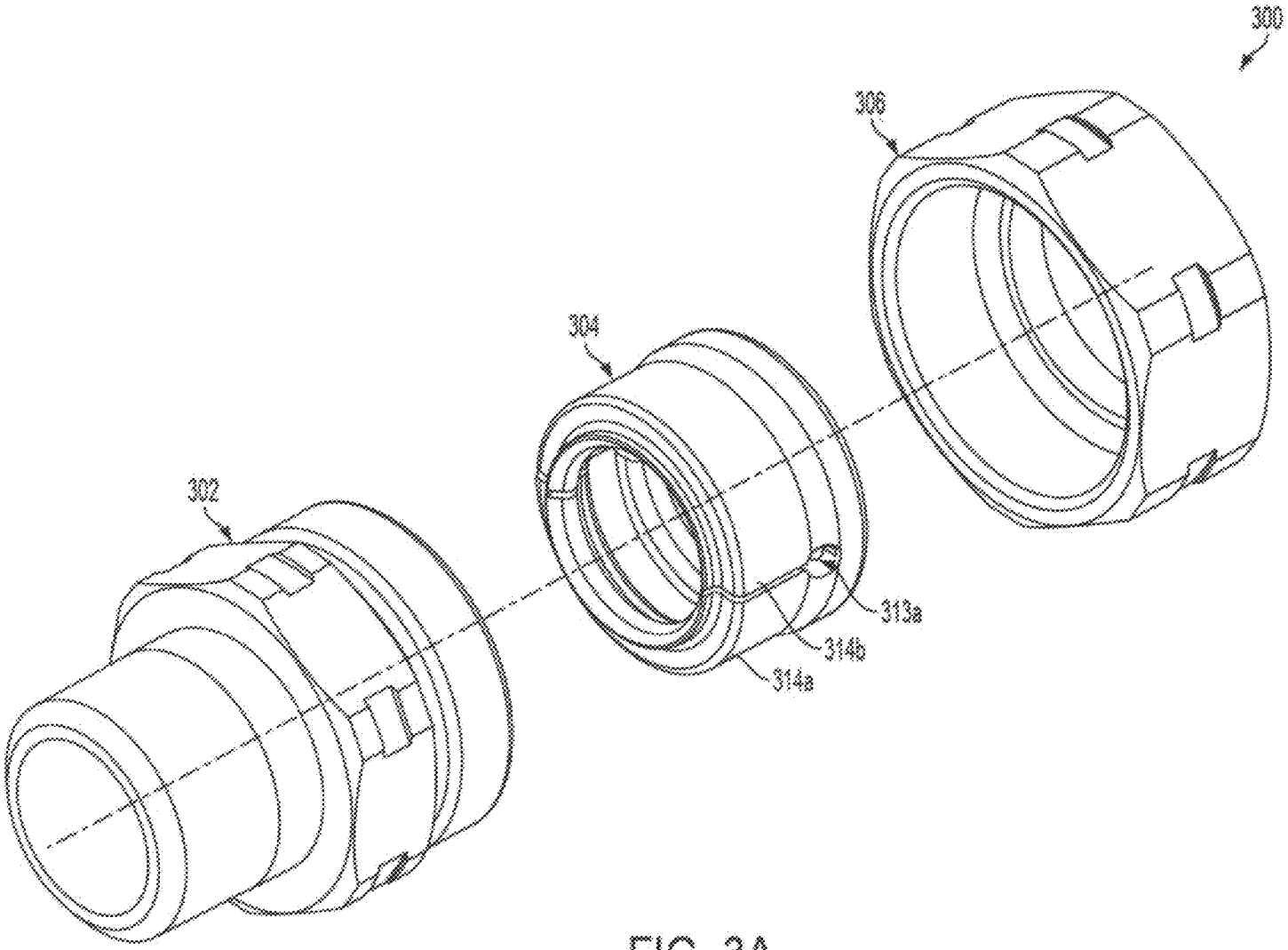
FIGS. 3A-3C depict embodiments of a sealing device and tubing assembly in accordance with preferred embodiments of the invention.

Referring now to FIG. 3A, an exploded view of a sealing device 300 is provided. This sealing device is further described in International Application No. PCT/US2014/035452, filed Apr. 25, 2014. The sealing device 300 allows for the sealing and coupling of an end of tubing (not depicted) to a pipe, a manifold, an appliance, and the like (not depicted). For example, after body member 302 is threaded onto a manifold (not depicted), tubing 200 and bushing 304 can be placed inside the a sleeve portion of the body member 302 and sealed by advancing a nut 306 as further discussed below.

Although the assembly 300 can be used with a variety of types of CSST, the bushing 304 is particularly advantageous when used with energy dissipative tubing having one or more conductive layers.

Figure 3B:
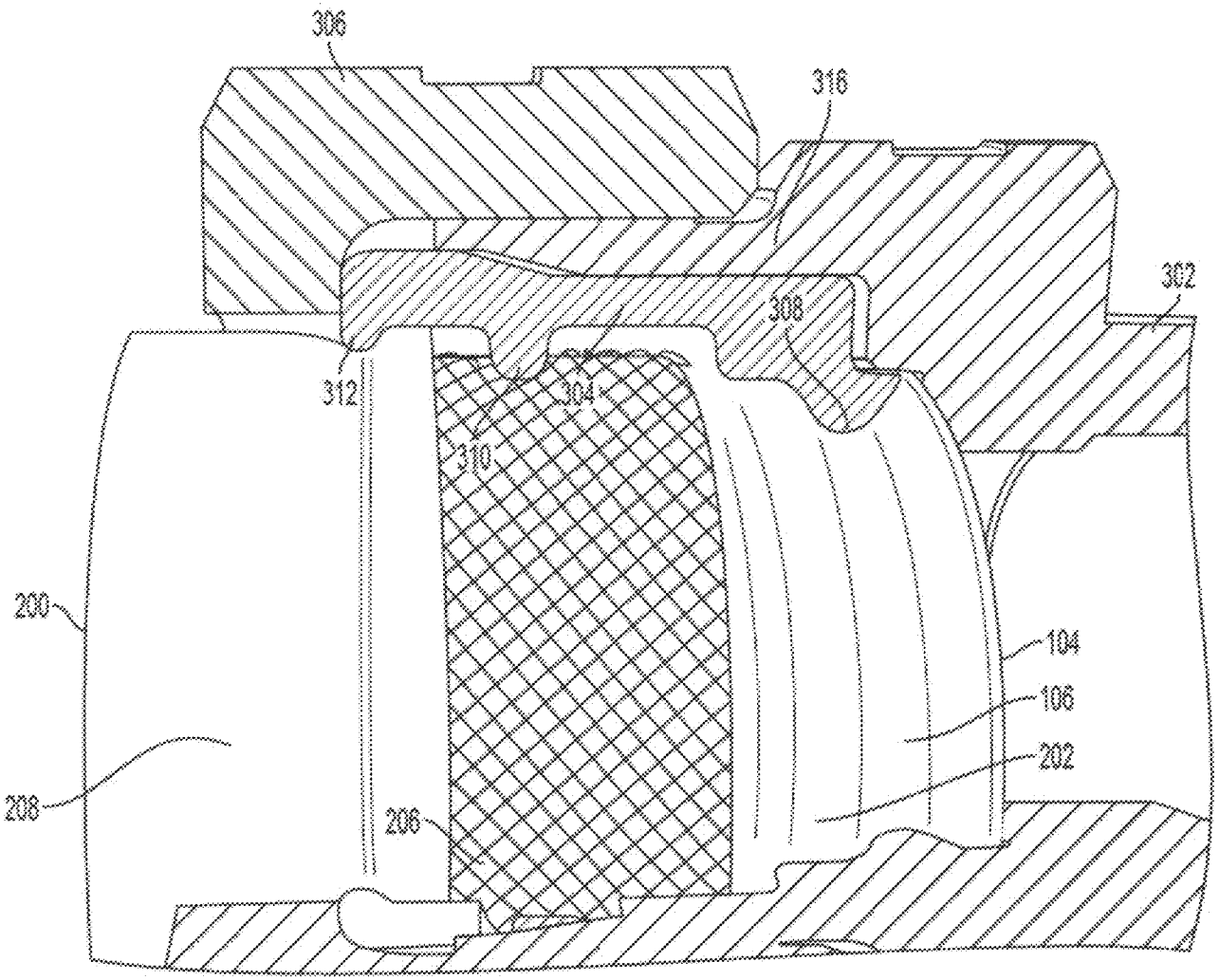
Figure 3C:
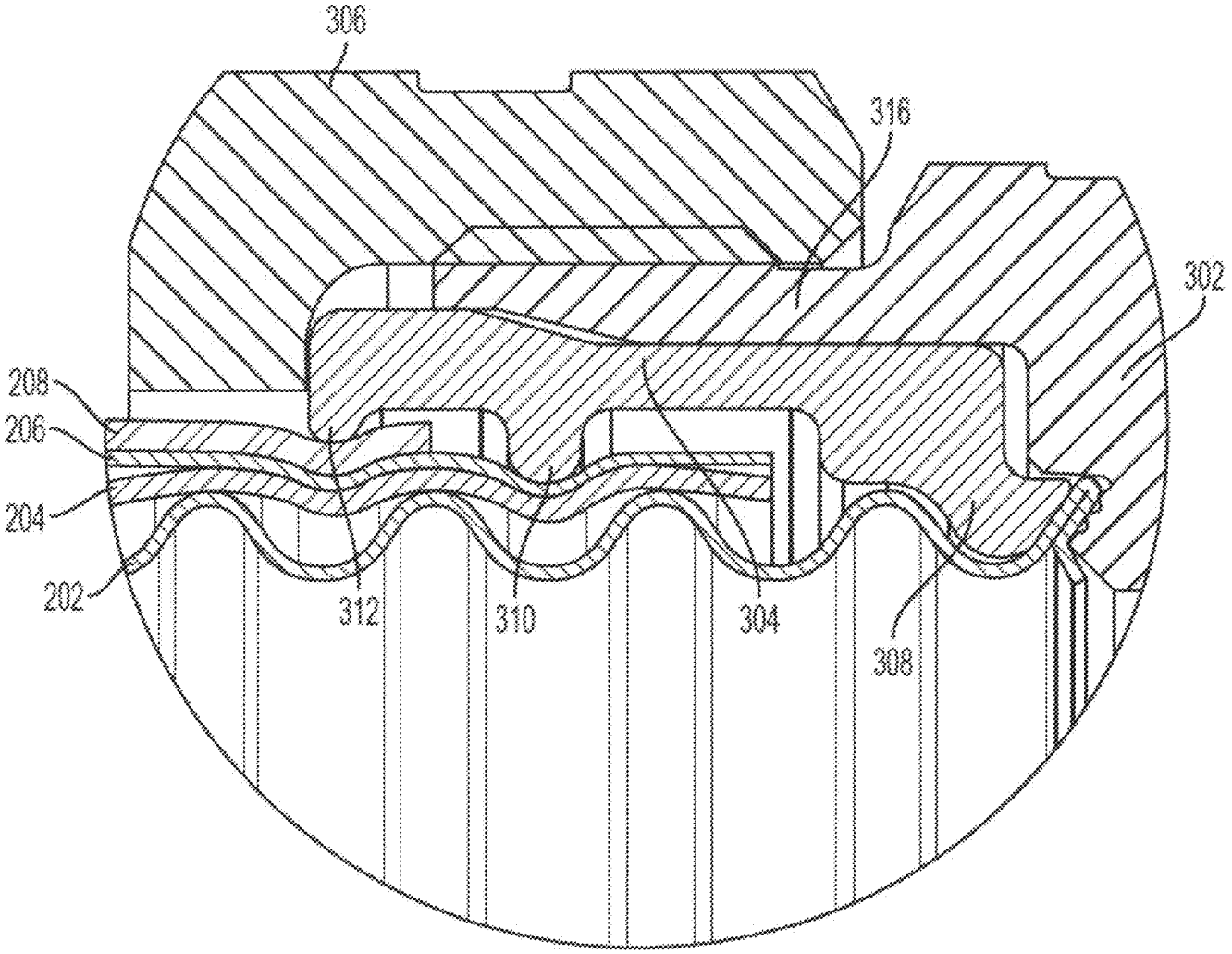

Referring now to FIGS. 3B and 3C, partial cross-sections of the assembly 300 are provided to show the internal structure of bushing 304. Bushing 304 includes a first annular rib 308 adapted and configured to engage with corrugation valley 106 of the corrugated tubing 202.

In one embodiment, the first annular rib 308 engages the first corrugation valley 106 of the tubing to facilitate the sealing of the tubing 202 against the body member 302. As the nut 306 is advanced, the first annular rib 308 of the bushing 304 presses the tubing 202 against the sealing face of the body member 302, causing the first corrugation peak 104 to collapse and form a gastight seal.

Bushing 304 also includes a second annular rib 310. Second annular rib 310 is adapted and configured to press against and form electrical continuity with conductive layer 206 so that any electricity received in the conductive layer 206 will flow through the second annular rib 310 and bushing 304. In order to facilitate as large of a contact area as possible between the conductive layer 206 and the second annular rib 310, second annular rib 310 has a rounded, substantially non-piercing profile. Preferably, second annular rib 310 is positioned along bushing 304 with respect to the first annular rib 308 such that when the first annular rib 308 engages with a corrugation valley 106, the second annular rib 310 will also be positioned over another corrugation valley 106 so that the second annular rib 310 can press the conductive layer 206 (and any layers 204 below) into the corrugation valley 106 and create further contact between the second annular rib 310 and the conductive layer 206.

Preferably, second annular rib 310 can be located over the third corrugation valley 106 of the tubing (as seen in FIG. 3D), but may also be located at the second or fourth corrugation valley 106. Locating second annular rib 310 over a corrugation valley 106 is favorable so as to prevent any direct contact with layers 204 or 206 and the corrugated tubing 202 beneath when the bushing 304 is assembled onto the tubing. Direct contact between these layers 204, 206 and the tubing 202 due to the compression from bushing 304 may result in undesired mechanical interference that leads to difficult assembly or decreased performance or longevity.

Bushing 304 can include one or more through-holes 313*a*, 313*b* passing through bushing 304 at the location of (e.g., centered on) the second annular rib 310. Through-holes 313 prevent or relieve bunching of the conductive layer 206 and the first resin layer 204 when the bushing 304 is applied to the tubing 200.

Bushing 304 can also include a third annular rib 312 adapted and configured to press against an outer jacket 208 to prevent outer jacket 208 from withdrawing from the fitting 300 and to prevent foreign objects or substances from entering fitting 300. Like second annular rib 310, third annular rib 312 can be positioned with respect to the first annular rib 308 such that the third annular rib 312 presses the jacket 208 and any jacket layers below into a corrugation groove 106.

Referring again to FIG. 3A, bushing 304 can, in some embodiments, be a split bushing. For example, bushing 306 can include two halves connected by a living hinge. A living hinge allows the bushing to open to allow halves 314*a*, 314*b* to slide over one or more corrugation peaks 104 before resting in a corrugation groove 106 and allowing the bushing 304 to return to a substantially circular profile for engagement with body member 302. In other embodiments, the bushing 304 is a two-piece split bushing such that each half of the split bushing is individually positioned on the tubing prior to insertion into the sleeve portion 316 of the body member 302.

Methods of Installing Tubing

Figure 4:
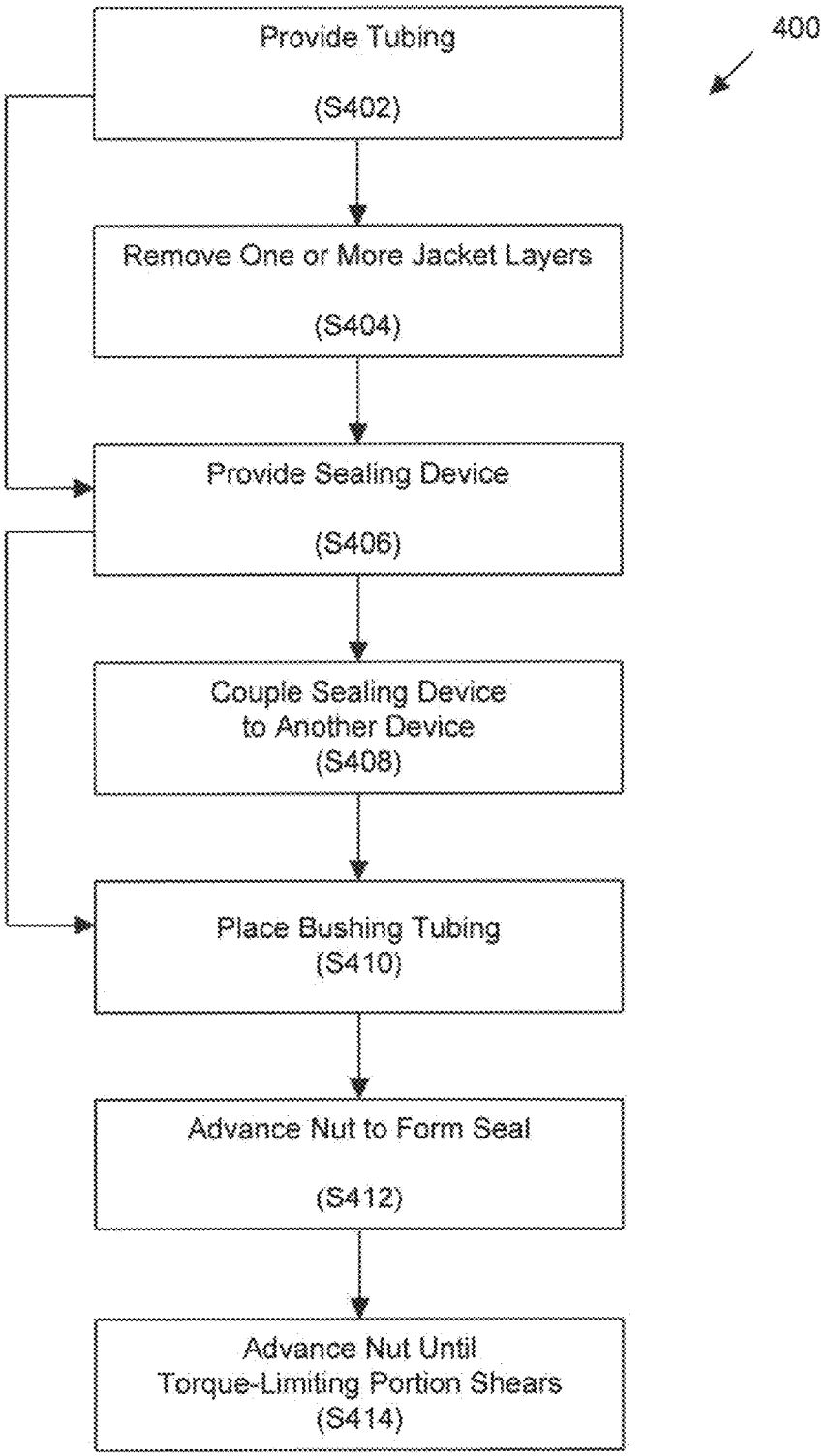
FIG. 4 depicts a method for installing energy dissipative tubing in accordance with preferred embodiments of the invention.

Tubing can be installed in accordance with existing techniques for the manufacture of CSST. An exemplary method 400 for installing energy dissipative tubing is depicted in FIG. 4.

In step S402, a length of tubing is provided. Tubing can, in some embodiments, be CSST such as unjacketed CSST, jacketed CSST, and energy-dissipative tubing. Tubing may be provided in lengths (e.g., 8' sticks) or on reels.

In step S404, one or more jacket layers are optionally removed in accordance with the instructions for a fitting. The one or more layers can be removed a jacket-stripping tool as described herein. Preferably, all jacket layers are removed from a leading end of the tubing. For example, all jacket layers can be removed to expose at least the first two corrugation peaks. Additionally, one or more outer jacket layers can be further removed to expose the conductive layer in a region corresponding to the second annular rib.

In step S406, a sealing device is provided including a body member defining a sleeve portion and a bushing as described herein.

In step S408, the sealing device is optionally coupled to another device. For example, the sealing device can be coupled to a source of a fuel gas such as a pipe, a manifold, a meter, a gas main, a tank, and the like. In another example, the sealing device can be coupled to an appliance that consumes a fuel gas such as a stove, an oven, a grill, a furnace, a clothes dryer, a fire place, a generator, and the like.

In step S410, the bushing is placed over the inner tubing layer. The bushing can be positioned such that the first annular rib engages with a first complete corrugation groove, the second annular rib engages with a conductive layer, and a third annular rib engages with an outer jacket layer.

In step S412, a nut is advanced to form a seal. The nut can be advanced by rotating the nut to engage threads in the sleeve portion of the body member.

In step S414, the nut is optionally tightened until a torque-limiting portion of the nut is activated. For example, a portion of the nut may shear off when a predetermined amount of torque is applied to the nut.

Jacket-Removing Tools

Referring now to FIG. 5, a jacket-removing tool 500 is provided. Jacket-removing tool 500 can include a body 502 defining two semicircular halves 504*a*, 504*b* that can be coupled by a hinge 506. Body 502 can include one or more slits 508 that can receive one or more cutting blades 510. Blades 510 can be arranged substantially perpendicular to a central axis of the tool 500 and adapted and configured to create one or more cuts through one or more external jacket layers of tubing or wire inserted within tool 500. Body 502 can also include one or more annular ribs 512. The annular ribs 512 can be adapted and configured to be received in the one or more cuts and to remove the one or more jacket layers cut by the one or more cutting blades when the tool 500 is pulled axially with respect to the tubing or wire.

Hinge 506 can be a living hinge or can be a barrel hinge, a continuous or piano hinge, and the like. The use of a living hinge advantageously allows body 502 to molded as a single unit as depicted most clearly in FIG. 5B.

Slits 508 can extend partially through body 502 such that blades 510 will generally be held at a tangent and at a defined distance with respect to tubing or wire placed within tool 500.

The cutting blades 510 and the internal annular ribs 512 can be positioned on substantially opposite ends of tool 500. In some embodiments, a divider 514 is positioned between the cutting blades 510 and the internal annular ribs 512. Divider 514 can advantageously provide a reference stop to guide the user to properly position tubing or wire within either end of the tool 500. For example, when the tubing is corrugated stainless steel tubing, it may be desirable to cut certain jacket layers at various positions relative to corrugation peaks 104 and valleys 106. The relative positioning of cutting blades 510 and internal annular ribs 512 with respect to divider 514 can be coordinated so that the cutting blades 510 and the internal annular ribs 512 are positioned at substantially the same distance from an exterior surface of the divider 514 so that when the tubing or wire is fully inserted, the internal annular ribs 512 will align with the cuts previously made by the cutting blades 510.

Cutting blades 510 can advantageously be commercially-available disposable blades commonly known as razor blades or utility blades and available from a variety of manufacturers including Stanley Black & Decker of New Britain, Conn.; IRWIN Industrial Tool Company of Atlanta, Ga.; and the like.

Cutting blades 510 can be removably mounted in the one or more slits 508 through a variety of means. In the embodiment depicted in FIG. 5, covers 516*a*, 516*b* are removably placed over blades 510 to hold blades 510 in place. Covers 516*a*, 516*b* can be removably held in place by tabs 518 or other devices. In other embodiments, blades 510 and/or covers 516 can be held in place by straps, detents, latches, screws, bolts, pins, fasteners, adhesives, magnets, and the like.

Internal annular ribs 512 can, in some embodiments, be tapered or beveled in order to better penetrate the cuts in the jacket formed by the cutting blades 510.

Figure 5A:
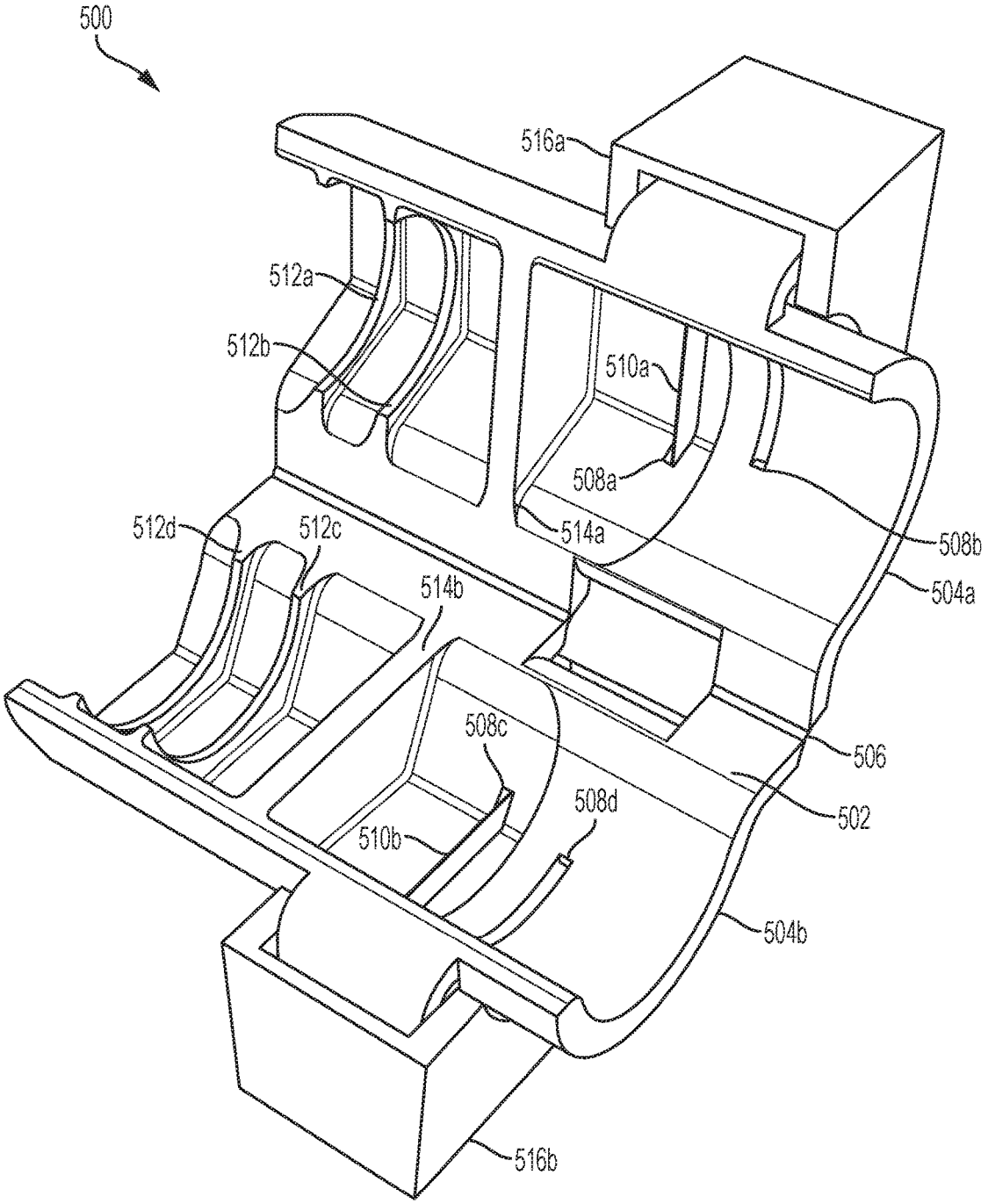
FIGS. 5A-5D depict embodiments of a jacket-removing tool in accordance with preferred embodiments of the invention.
Figure 5B:
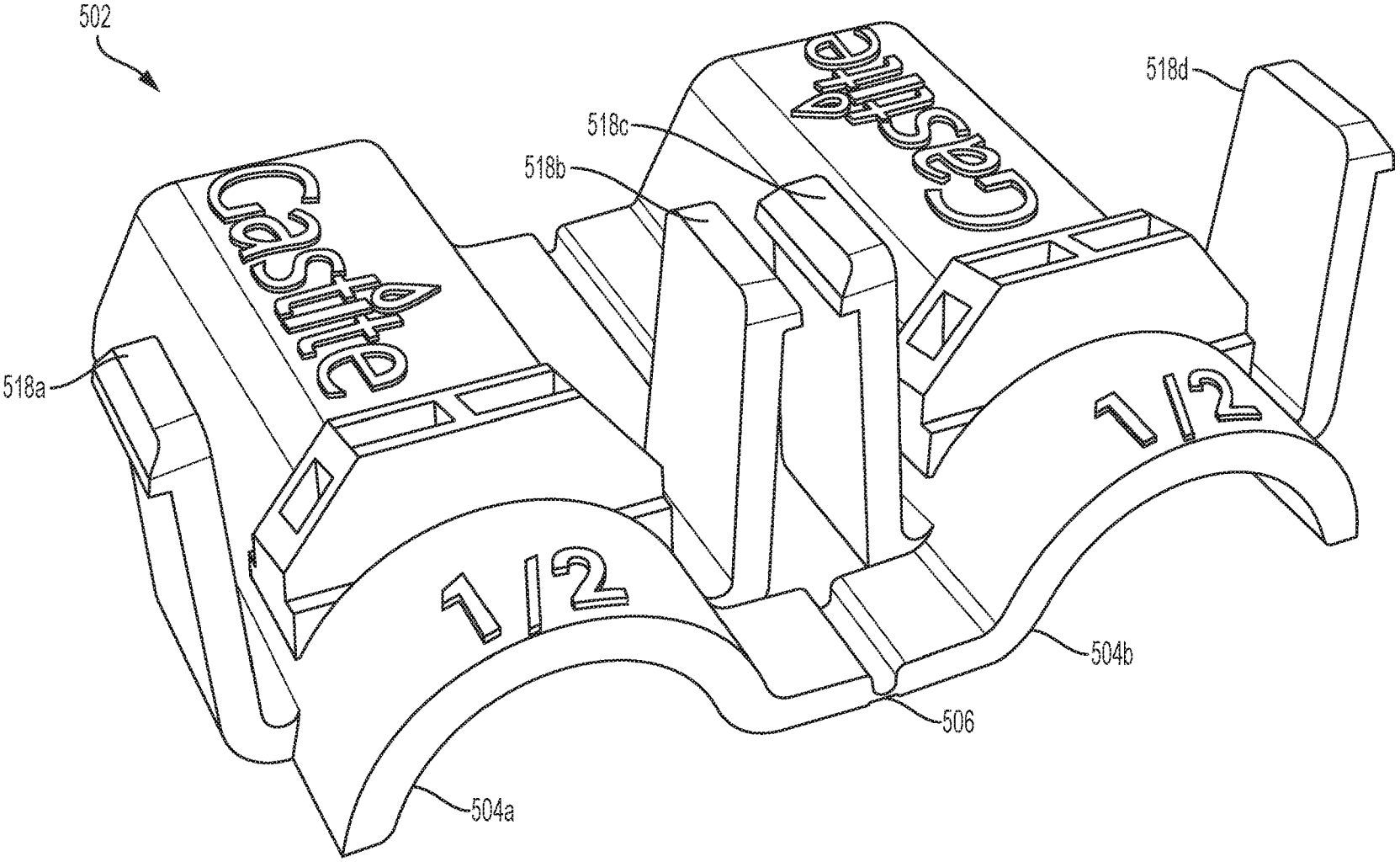
Figure 5C:
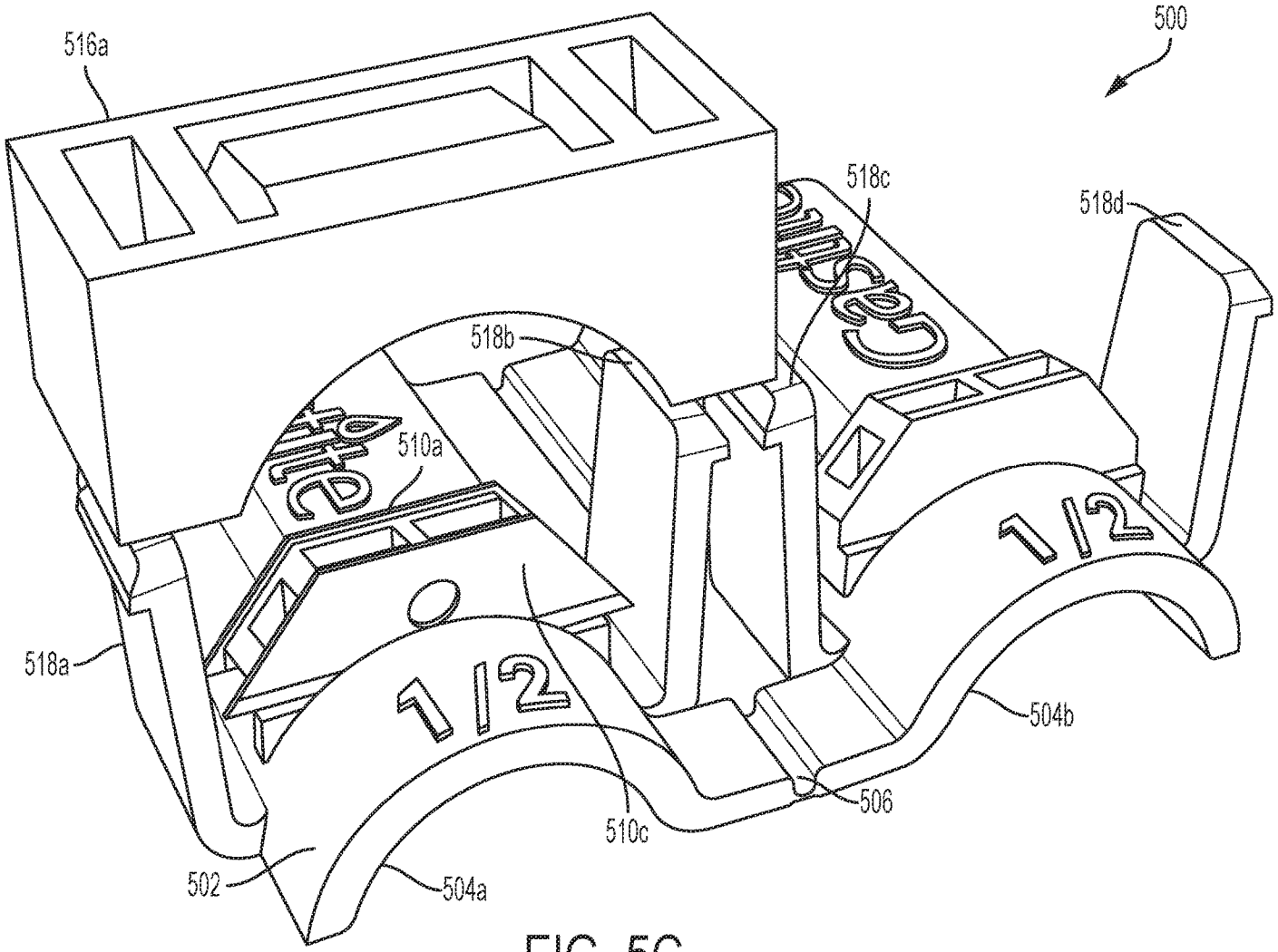
Figure 5D:
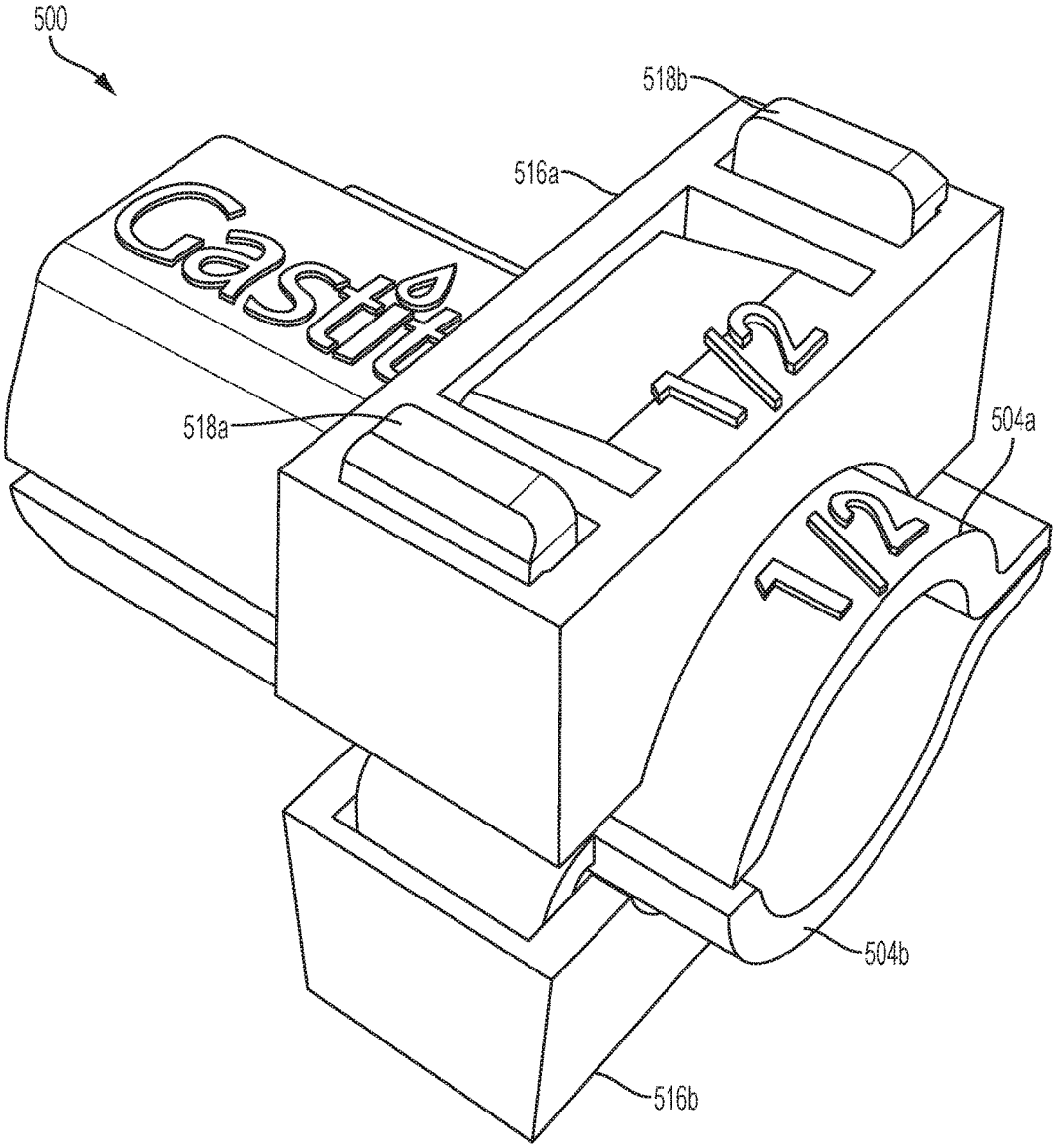

Tool 500 can be configured either by the designer or by the end user to accommodate various tubing, wire, and/or fittings. For example, when used in conjunction with the tubing 200 depicted in FIGS. 2A-2D and the fitting 300 depicted in FIGS. 3A-3E, four cutting blades 510 can be utilized with two blades 510 being positioned on each half 502. The cutting blades 510 can be positioned at varying depths on each half 502 so that a first pair of cutting blades 510 will only penetrate outer layer 208 while a second pair of cutting blades 510 will penetrate through all jacket layers 204, 206, 208. As can be seen in FIG. 5A, in some embodiments, the inner diameter of tool 200 around the blades varies such that the inner diameter is larger nearest to divider 514. This larger diameter provides clearance for jacketing that may be been wrinkled or damaged at the end of the tubing when it was cut to length. The smaller inner diameter of tool 200 around the blades is used to set the depth for cutting blades 510 by providing a stop against the outer diameter of the outermost jacket. This is advantageous for cutting of the outer layer 208 in that the depth of the blade can be accurately placed using only the thickness dimension of the outer jacket. This prevents tolerance stack up from the dimensions of the tubing and jackets that may occur if the blade depth were set according only to the outer diameter of the tubing 200. To accomplish this, when tool 500 is completely closed onto tubing 200, hinge 506 typically has a remaining 1-5 degrees of travel to accommodate tubing that is undersized and to ensure that the small inner diameter of tool 500 is in contact with the outer diameter of tubing 200.

When used in conjunction with tubing having a single-layered jacket, one or two cutting blades 510 can be sufficient.

Tool 500 can be produced in various sizes to accommodate tubing and wire of various sizes. For example, tool 500 can be sized to accommodate various sizes of corrugated stainless steel tubing including nominal sizes of ⅜", ½", ¾", 1", 1¼", 1½", and 2". Additionally, although tool 500 has been described in the context of corrugated stainless steel tubing, one of ordinary skill in the art will readily appreciate that tool 500 can be used in conjunction with multi-layer tubing and jacketed wiring including, for example, coaxial cable such as RG-59 cable.

As discussed herein, tool 500 can economically be formed through plastic molding techniques. For example, tool 500 can be fabricated from various plastics such as thermoplastics (e.g., acrylonitrile butadiene styrene (ABS), polyethylene, polypropylene, polystyrene, and polyvinyl chloride) or thermosetting plastics. Tool 500 can also be formed from metals and other materials using known techniques such as casting, molding, machining, and the like.

Methods of Removing Jacket Layers

Figure 6:
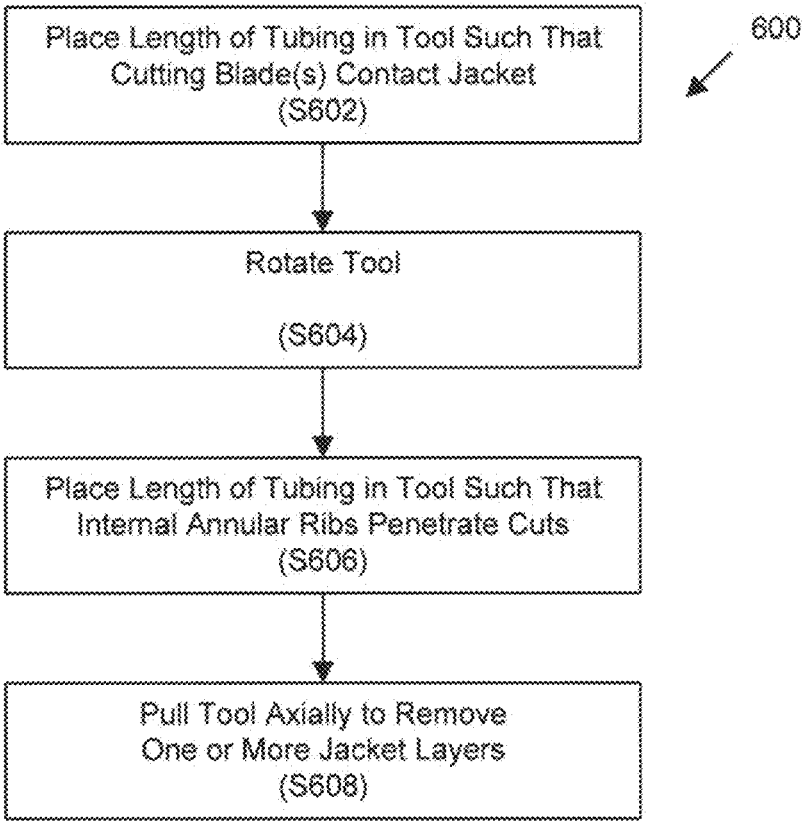
FIG. 6 depicts a method of removing one or more external jacket layers from tubing or wire in accordance with preferred embodiments of the invention.

Referring now to FIG. 6, a method 600 of removing one or more external jacket layers from tubing or wire is provided.

In step S602, a length of tubing or wire is placed in the tool as described herein such that the one or more cutting blades contact an outermost jacket layer of the length of tubing or wire. The length of tubing or wire can be inserted until the length of tubing or wire contacts a divider as discussed above.

In step S604, pressure is applied to the outside of the tool and the tool is rotated with respect to the length of the tubing or wire. Light hand pressure and multiple rotations in alternating directions is preferable to ensure a clean cut through each layer. Depending on how many cutting blades are used, it may not be necessary to rotate the tool for a complete revolution. For example, if a pair of corresponding blades are utilized, rotating the tool about 200° will be sufficient to completely cut through one or more jacket layers. If necessary, a wrench or pliers (e.g., locking pliers sold under the VISE-GRIP® trademark by IRWIN Industrial Tool Company of Atlanta, Ga.) can be utilized to provide additional compression and/or torque.

In step S606, the length of tubing or wire is placed in the tool such that the one or more internal annular ribs penetrate the one or more cuts.

In step S608, the tool is pulled axially to remove the one or more external jacket layers.

Blade Holder

Figure 7:
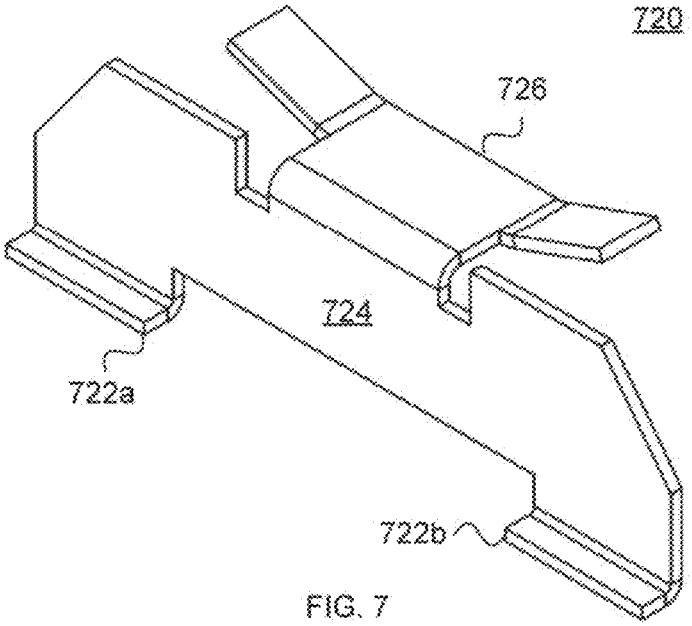
FIG. 7 depicts a blade holder that holds blades at a defined depth in accordance with preferred embodiments of the invention.

Referring now to FIG. 7, another embodiment of the invention provides a blade holder 720 that holds blades 510 at a defined depth. Blade holders 720 advantageously resist wear from the blades and protect body 502 from wear that can, over time, result in blades 510 cutting deeper into jacket layers. Such approach advantageously enables long-term consistent use of commercially available blades 510. Alternatively, blade 510 could be produced with a dull edge in the regions that are in contact with the body 502.

Blade holder 720 can include one or more flanges 722*a*, 722*b* adapted and configured to contact the cutting edge of the blade 510. Flanges 722 can be sized to fit within a groove formed within body 502. For example, flanges 722 can extend about 0.04" from the surface 724 that is substantially parallel to the blade 510. Blade holder 720 can also include one or more additional flanges 726 adapted and configured to hold the blade holder 720 in a defined position relative to body 502.

Blade holder 720 can preferably be fabricated from or coated with a material having about the same or greater hardness than blades 510 (which are typically made from stainless steel).

Further Jacket-Removing Tools

Referring now to FIGS. 8A-8G, another embodiment of the invention provides further jacket-removing tools 800 incorporating one or more blade holders 820.

Body 802 can be fabricated from a plastic such as polypropylene in a single molding that defines halves 804*a*, 804*b*, and living hinge 806. Covers 816*a*, 816*b* can also be fabricated from a plastic such as ABS.

The blade holders 820 can be designed to slip into a pocket and retain themselves there permanently. In some embodiments such as those depicted in FIGS. 8A-8E, blade holders 820 are only used on the end of the tool 802 used for cutting only the outer resin layer of the tubing. Although blade holders 820 can be used on both ends of the tool, the blade holders 820 are particularly useful in preventing overcutting the outer resin layer and damaging the metal layer, which is often a relatively thin layer of aluminum foil. Overcutting can be better tolerated when cutting through all jacket layers to reveal the underlying CSST.

Four blades 810 can be utilized, with two blades on each end of the tool positioned opposite each other in each half 804*a*, 804*b*. The blades 810 are replaceable by removing the covers 816.

Pressure exerted by the user pushes the covers 816 against the blades 810, the blades 810 against the blade holders 820, and the blade holder 820 against the body 802. This sets the depth of the blade 810 from the face of body halves 504, which rides along the outside of the tube.

Figure 8A:
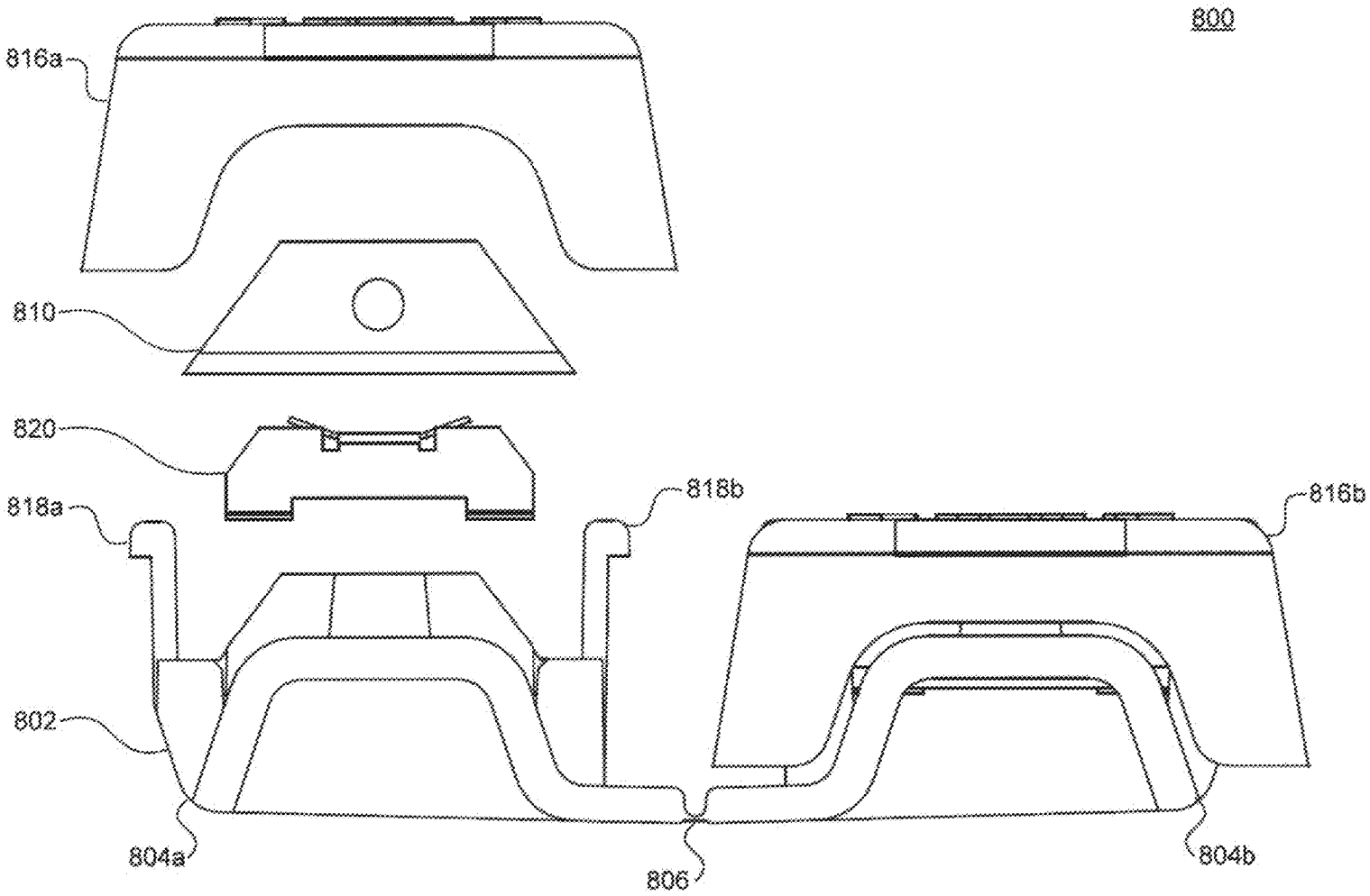
FIGS. 8A-8G depict a further jacket-removing tool incorporating one or more blade holders in accordance with preferred embodiments of the invention.
Figure 8B:
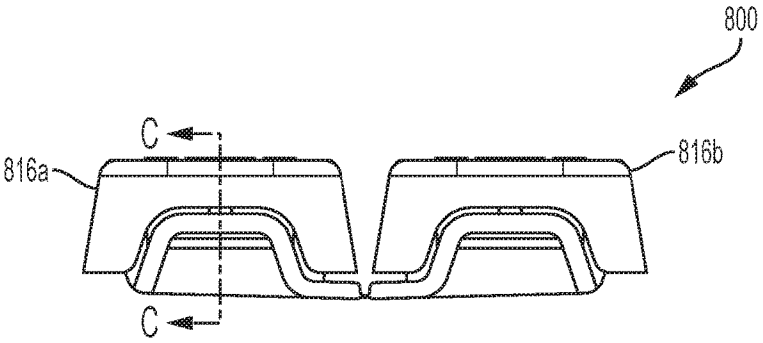
Figure 8E:
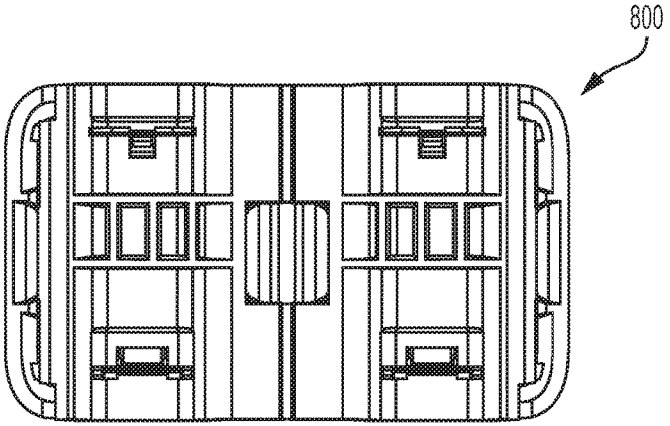
Figure 8C:
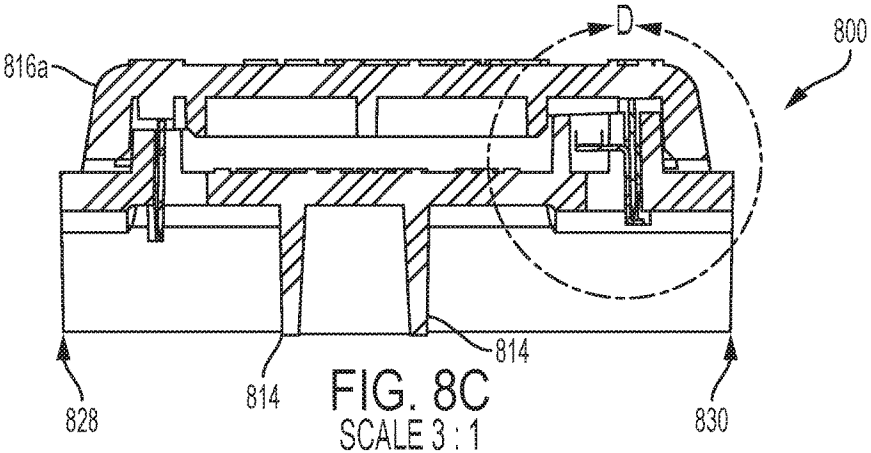
Figure 8D:
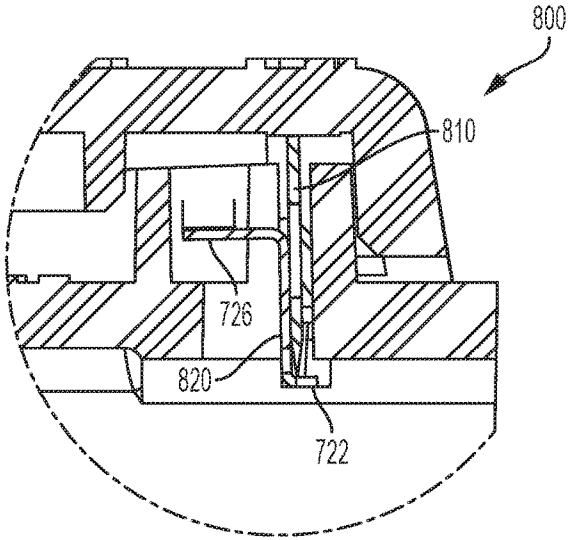
Figure 8G:
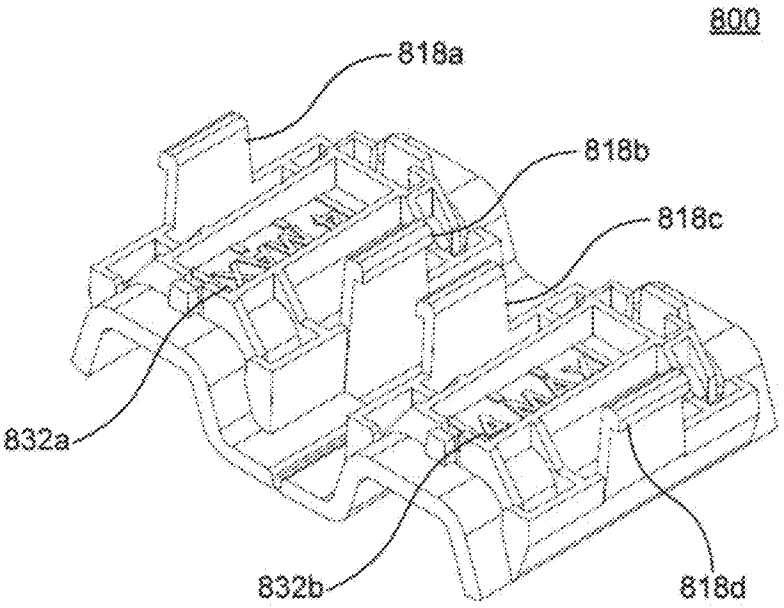
Figure 8F:
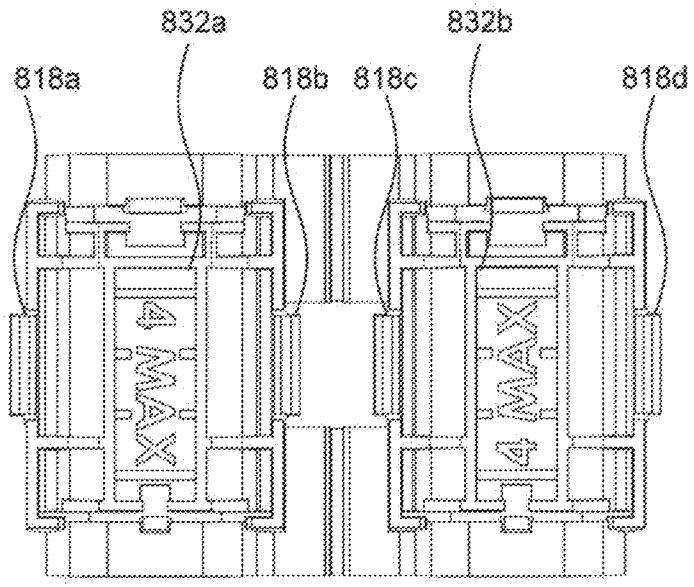

The tool 800 can be assembled using two molded tabs 818 per cover and a blade storage area 832 can be provided under the covers 816 as depicted in FIGS. 8F and 8G.

Two blades 810 on a first end 828 of the tool 800 cut through and strip all coatings and two blades on the opposite, second end 830 of the tool 800 cut through and strip the outer layer only. Preferably, the blades 810 on the first end 828 are spaced from a divider 814 such that when the tubing contacts the divider 814, the blades 810 will be positioned over a corrugation valley 106. Such a positioning allows for the blades 810 to penetrate through all jacket layers and into the corrugation valley 106 without contacting the underlying corrugated stainless steel tubing, which could dull blades. Blades 810 can be predictably and repeatedly positioned over corrugation valleys 106 by designing tool 800 so that the distance between the contact surface of the divider 814 and the blades 810 is or approximates (e.g., within about 10%) a multiple (e.g., 1, 2, 3, 4, 5, and the like) of a distance $d_v$ between adjacent corrugation valleys 106 of the corrugated stainless steel tubing.

Although the valley-to-valley distance $d_v$ may vary between manufacturers and products, the valley-to-valley distance $d_v$ is reliably stable because each manufacturer's fittings engage one or more corrugations in order to form a seal. Moreover, CSST is conventionally cut using a plumber's tubing cutter at a corrugation valley, which the tubing cutter will seek as it rotates and the cutting wheels are tightened. CSST brands specifying the use of a tubing cutter at a corrugation valley include the GASTITE® and FLASHSHIELD® brands by Titeflex Corporation of Portland, Tenn.; TRACPIPE® and COUNTERSTRIKE® brands by OmegaFlex, Inc. of Exton, Pa.; and DIAMONDBACK™ brand by Metal Fab, Inc. of Wichita, Kans.

Accordingly, it is envisioned that tool 800 (as well as tools 500 and 900 described herein) can be designed for a particular manufacturer, product, and/or size. For example, a particular embodiment of tool 800 can be designed and marketed for use with GASTITE® FLASHSHIELD® 1¼" tubing. Embodiments of tool 800 can be marketed and sold as part of a system including compatible tubing and fittings. In one embodiment, tool 800 can be marketed and sold as part of a kit that also includes instructions for use of the tool to remove one or more jacket layers from a compatible length of tubing. The instructions can specify which tubing is compatible (e.g., by brand, size, model number, and the like) and/or which tubing is not compatible.

Plastic ribs can be omitted and the blades 810 can be utilized to pull the desired jacket layers off the end of the tube after cutting.

Figure 9A:
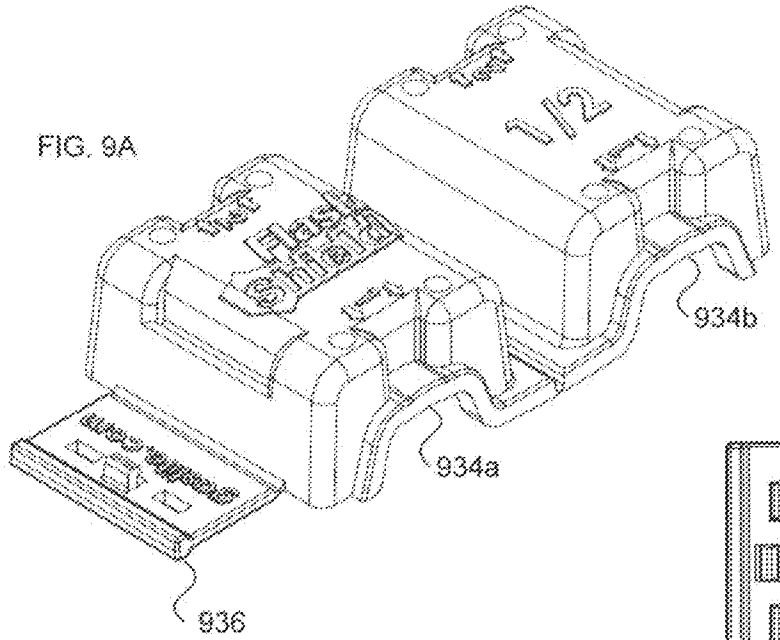
FIGS. 9A-9C depict another jacket-removing tool in accordance with preferred embodiments of the invention.
Figure 9B:
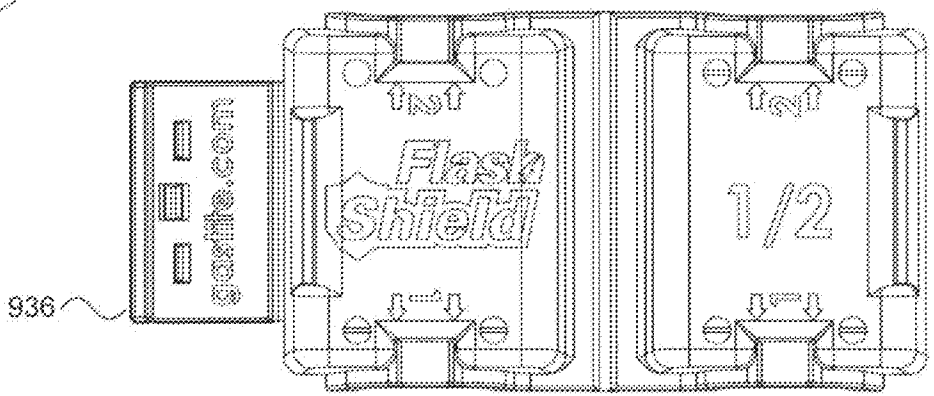
Figure 9C:
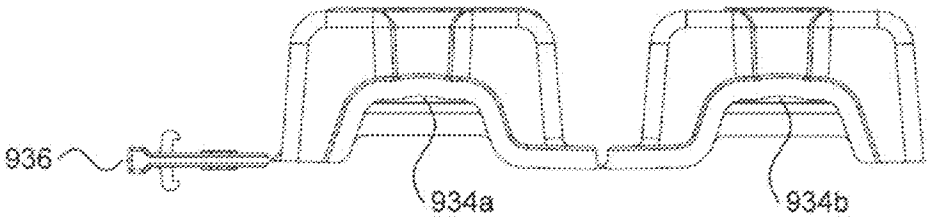

Referring now to FIGS. 9A-9C, another aspect of the invention provides another jacket-removing tool 900. Tool 900 can be a single-piece, injection-molded plastic (e.g., polyethylene) tool that has four non-removable blades molded into the body. By reducing the number of parts to be molded and eliminating assembly, the tool is less expensive and less complicated. The tool 900 can have a substantially hexagonal profile when closed on the tubing with the exception of a small semicircular face 934 that bears on the tubing. (This geometry can also be applied to the other tools 500, 800 described herein.) When compared with an entirely circular profile, such a profile ensures that anomalies affecting the outer shape of the tubing 200 in areas not proximal to the blades 910 do not substantially change the depth of the blade 910 while the blades 910 are in the cut. The small semicircular surface 934 also provides a loading bearing area to distribute the clamping force exerted on the tool 900, thereby reducing deformation of the outer jacket 208 that can be caused when a flat surface is pressed against the tangent outer diameter of the tubing 200. One knowledgeable in the art can configure the area based on the elastic modulus of the jacketing material and the expected clamping force. For typical hand loading, this area can be between about 0.05 $in^2$ and about 0.25 $in^2$.

As with tool 800, tool 900 utilizes two blades on one end of the tool 900 to cut through and strip all coatings and two blades on the opposite end of the tool 900 to cut through and strip the outer layer only. Tool 900 can include a latch 936 that can either keep the tool 900 closed for storage (thereby shielding the user from the cutting edges of the blades 810) or snap to the side of the tool 900 when the tool 900 is in use.

Preferably, tools 500, 800, 900 permit a user to compress the tool 500, 800, 900, rotate the tool 500, 800, 900 to cut the one or more jacket layers, and pull the tool 500, 800, 900 axially to remove the one or more jacket layers from the tubing end. In some embodiments, tool 500, 800, 900 can be made thicker to provide additional torque. Additionally or alternatively, various geometries, coatings, overmoldings, knurlings, and/or contours can be applied to the exterior of the tools 500, 800, 900 in order to enhance the user's comfort, grip, and the like.

In some embodiments, tools 500, 800, 900 can include a spring adapted and configured to open tools 500, 800, 900 to an axially-pulling position in which the blades 810 still engage jacket layers, but lie outside the outer diameter of the underlying corrugated stainless steel tubing. Such an embodiment allows for one-handed operation without manually adjusting of the tool 500, 800, 900. The user can simply apply the tool 500, 800, 900, squeeze the tool 500, 800, 900 to press the blades into the jacket, rotate the tool 500, 800, 900, reduce pressure on the tool 500, 800, 900, and pull the tool 500, 800, 900 axially.

Blade Placement

Figure 10:
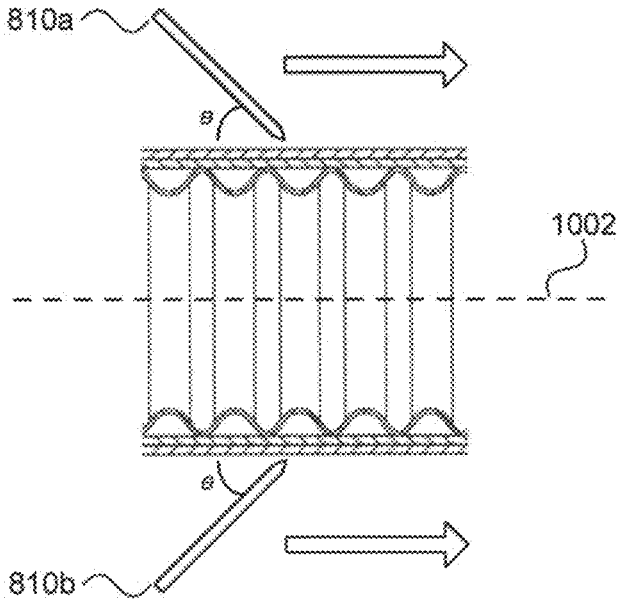
FIG. 10 depicts the angling of blades with respect to the central axis of the tubing in accordance with preferred embodiments of the invention.

As depicted herein, blades 510, 810, 910 can be held substantially perpendicular to the central axis of the tubing. In some embodiments, the tools 500, 800, 900 and/or blade holders 720, 820 can be adapted and configured to hold the blades 510, 810, 910 at an angle θ with respect to the central axis 1002 of the tubing 202 as depicted in FIG. 10. Such angling would "bite" into the jacket layers to be removed when the tool 500, 800, 900 is pulled axially toward the end of the tubing 200. Additionally, such angling should lessen the potential of the blades 510, 810, 910 to flex when used to pull the jacket layer. Suitable angles can range from about 45° to about 89.9° with respect to the central axis of the tool/tubing. For example, the blades 510, 810, 910 can be positioned at angles with respect to the central axis of the tool/tubing of between about 45° and about 50°, between about 50° and about 55°, between about 55° and about 60°, between about 60° and about 65°, between about 65° and about 70°, between about 70° and about 75°, between about 75° and about 80°, between about 80° and about 85°, between about 85° and about 86°, between about 86° and about 87°, between about 87° and about 88°, between about 88° and about 89°, between about 89° and about 89.9°, and the like.

Use of "Dull" Blades

Embodiments of the tools 500, 800, 900 can utilize blades 510, 810, 910 that have a dull edge instead of a sharp edge along the length of the blade 510, 810, 910. Such blades are particularly well suited to cut entirely through the outer resin layer 208 and rub against the aluminum foil 206 without cutting the foil 206. For example, if the outer jacket thickness is 0.025+/−0.002", the tools 500, 800, 900 can be designed for the blades 510, 810, 910 to cut to 0.027" deep without harming the foil.

Figure 11A:
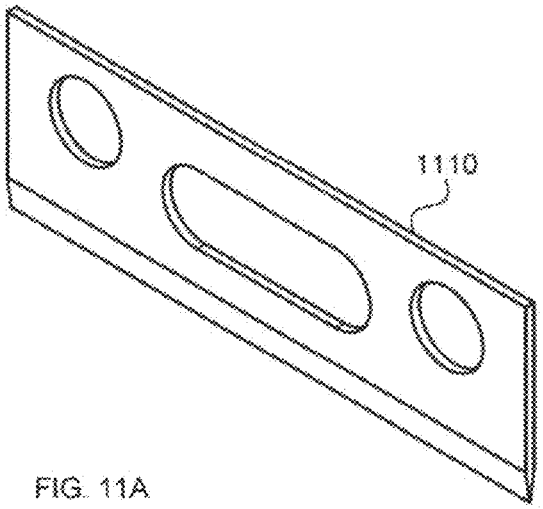
FIGS. 11A-11C depict a blade having a substantially flat surface between two facets in accordance with preferred embodiments of the invention.
Figure 11B:
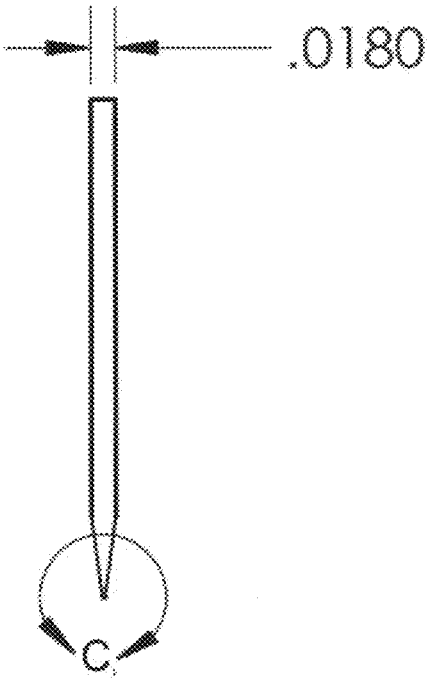
Figure 11C:
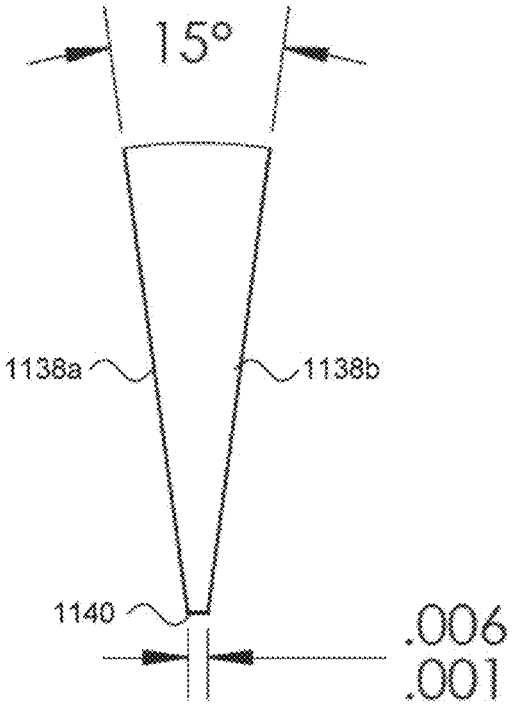

FIG. 11 depicts an exemplary geometry of a dull blade 1110. Facets 1138*a*, 1138*b* can be ground on each side of the blade 1110. Facets 1138 can be formed at a variety of angles with respect to each other. For example, the angle can be between about 10° and about 11°, between about 11° and about 12°, between about 12° and about 13°, between about 13° and about 14°, between about 14° and about 15°, between about 15° and about 16°, between about 16° and about 17°, between about 17° and about 18°, between about 18° and about 19°, between about 19° and about 20°, and the like.

Blade 1110 can also include a flat surface 1140 instead of the usual point where facets 1138 would meet. In one embodiment, flat surface 1140 has a cross-sectional width of between about 0.001" and about 0.006". Flat surface 1140 can be formed by grinding after facets 1138 are ground. Alternatively, facets 1138 can be ground to a shallower depth, thereby leaving a flat surface 1140 between the facets 1138.

While the blades 510, 810, 910 should still be held to a predefined depth, use of a "dull" blade does allow for a looser tolerance on the depth of the blades 510, 810, 910 and could be easier to manufacture.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A jacket-stripping tool comprising:

a body defining a substantially cylindrical internal chamber, wherein the body has a substantially hexagonal profile when in a closed position, wherein the substantially hexagonal profile includes a semicircular face that bears on the one or more external jacket layers of the corrugated stainless steel tubing;

a reference stop dividing the substantially cylindrical internal chamber into a first tool end and a second tool end, the reference stop adapted and configured to contact an end of corrugated stainless steel tubing; and one or more cutting blades having a cutting edge arranged substantially perpendicular to a central axis of the tool and adapted and configured to create one or more cuts through one or more external jacket layers of the corrugated stainless steel tubing, wherein:

at least one of the one or more cutting blades is positioned in each of the first tool end and the second tool end; and at least one of the one or more cutting edges is positioned relative to the reference stop such that a distance between the at least one of the one or more cutting edges is a multiple of a distance between adjacent corrugation valleys of the corrugated stainless steel tubing.

2. The tool of claim 1, wherein at least one of the one or more blades are positioned so that a body of the cutting blade is angled away from the reference stop.

3. The tool of claim 1, wherein the tool includes two halves.

4. The tool of claim 3, wherein at least one of the one or more cutting blades is included on each of the two halves.

5. The tool of claim 3, wherein the halves are coupled by a hinge.

6. The tool of claim 5, wherein the hinge is a living hinge.

7. The tool of claim 1, wherein at least one of the one or more cutting blades includes a substantially flat surface between two facets.

8. A kit comprising:

the tool of claim 1; and instructions to:

cut a length of corrugated stainless steel tubing at a corrugation valley;

place the tool over an end of the length of corrugated stainless steel tubing so that the end of the length of corrugated stainless steel tubing contacts the reference stop of the tool;

compress and rotate the tool to cut through one or more jacket layers of the length of the corrugated stainless steel tubing; and pull the tool axially toward the end of the length of the corrugated stainless steel tubing to remove the one or more jacket layers.

9. The kit of claim 8, wherein the instructions further include a step of:

partially expanding the tool prior to the pulling step.

10. A method of removing one or more external jacket layers from corrugated stainless steel tubing, the method comprising:

providing the tool of claim 1;

placing a length of corrugated stainless steel tubing in the tool of claim 1 such that the one or more cutting blades contact an outermost jacket layer of the length of corrugated stainless steel tubing;

rotating the tool with respect to the length of corrugated stainless steel tubing;

placing the length of corrugated stainless steel tubing in the tool such that the one or more internal annular ribs penetrate the one or more cuts; and pulling the tool axially to remove the one or more external jacket layers.

11. A jacket-stripping tool comprising:

a body defining a substantially cylindrical internal chamber, wherein the body has a significantly hexagonal profile when in a closed position, wherein the substantially hexagonal profile includes a semicircular face that bears on the one or more external jacket layers of the corrugated stainless steel tubing;

a reference stop dividing the substantially cylindrical internal chamber into a first tool end and a second tool end, the reference stop adapted and configured to contact an end of a length of corrugated stainless steel tubing;

a first set of one or more cutting blades, at least one of which has a first cutting edge that is:

arranged substantially perpendicular to a central axis of the tool in the first tool end;

positioned relative to the reference stop such that the first set cutting edge is a multiple of a distance between adjacent corrugation valleys of the length of corrugated stainless steel tubing; and protruding from the body into the chamber such that when the length of corrugated stainless steel tubing cut at an end coinciding with a corrugation valley is inserted in the first tool end and the body is compressed around the length of corrugated stainless steel tubing and rotated, the at least one of the first set of one or more cutting blades cuts through all jacket layers of the length of tubing at another corrugation valley; and a second set of one or more cutting blades having a second cutting edge arranged substantially perpendicular to the central axis of the tool in the second tool end, the second cutting edge comprising a substantially flat surface between two facets.

12. The tool of claim 11, wherein the second set of cutting blades protrude from the body into the chamber such that when the length of corrugated stainless steel tubing is inserted into the second tool end and the body is compressed around the length of corrugated stainless steel tubing and rotated, the at least one of the second set of one or more cutting blades cuts through an outer jacket layer, but does not cut through an intermediate conductive layer.

13. The tool of claim 11, wherein the tool includes two halves.

14. The tool of claim 13, wherein the halves are coupled by a hinge.

15. A jacket-stripping tool comprising:

a body defining a substantially cylindrical internal chamber, wherein the body has a significantly hexagonal profile when in a closed position, wherein the substantially hexagonal profile includes a semicircular face that bears on the one or more external jacket layers of the corrugated stainless steel tubing;

a reference stop dividing the substantially cylindrical internal chamber to form a first tool end and a second tool end, the reference stop adapted and configured to contact an end of a length of corrugated stainless steel tubing;

a first set of one or more cutting blades, at least one of which has a first cutting edge that is:

arranged substantially perpendicular to a central axis of the tool in the first tool end;

positioned relative to the reference stop such that the first cutting edge is a multiple of a distance between adjacent corrugation valleys of the length of corrugated stainless steel tubing; and protruding from the body into the chamber such that when the length of corrugated stainless steel tubing cut at an end coinciding with a corrugation valley is inserted in the first tool end and the body is compressed around the length of corrugated stainless steel tubing and rotated, the first set of one or more cutting blades cuts through all jacket layers of the length of tubing at another corrugation valley; and a second set of one or more cutting blades having a second cutting edge arranged substantially perpendicular to the central axis of the tool in the second tool end, the second cutting edge protruding from the body into the chamber at a radially outward depth relative to the first set of cutting blades such that when the length of corrugated stainless steel tubing is inserted into the second tool end and the body is compressed around the length of corrugated stainless steel tubing and rotated, the second cutting edge cuts through an outer jacket layer, but does not cut through an intermediate conductive layer.

* * * * *